US009023230B1

(12) United States Patent
Sun et al.

(10) Patent No.: US 9,023,230 B1
(45) Date of Patent: May 5, 2015

(54) SURFACTANT-FREE SYNTHESIS OF MAGNETIC POLYPROPYLENE NANOCOMPOSITES

(75) Inventors: Luyi Sun, Pearland, TX (US); Zhanhu Guo, Beaumont, TX (US); Jiahua Zhu, Beaumont, TX (US); Suying Wei, Beaumont, TX (US)

(73) Assignees: Lamar University, A Component of the Texas State University System, An Agency of the State of Texas, Beaumont, TX (US); Texas State University San Marcos, A Component of the Texas State University System, An Agency of the State of Texas, San Marcos, TX (US)

( * ) Notice: Subject to any disclaimer, the term of this patent is extended or adjusted under 35 U.S.C. 154(b) by 39 days.

(21) Appl. No.: 13/306,964

(22) Filed: Nov. 29, 2011

Related U.S. Application Data

(60) Provisional application No. 61/458,827, filed on Dec. 3, 2010.

(51) Int. Cl.
*H01F 1/01* (2006.01)
*H01F 1/00* (2006.01)

(52) U.S. Cl.
CPC ..... *H01F 1/0054* (2013.01)

(58) Field of Classification Search
USPC ..... 252/62.54; 524/440, 431, 435
See application file for complete search history.

(56) References Cited

FOREIGN PATENT DOCUMENTS

WO WO 2009/141488 * 11/2009
WO WO 2012/011016 * 1/2012

OTHER PUBLICATIONS

Abstract II8.2 from Symposium II: Polymer-Based Nanocompsites, Dec. 1, 2010, "Magnetic Polypropylene Nanocomposites Filled wiith In-situ Synthesized Iron Nanoparticles", Guo et al.*
Zhu et al,"Magnetic Polypropylene Nanocomposites Filled wiith In-situ Synthesized Iron Nanoparticles", Mater. Res. Soc. Symp. Proc. vol. 1312. pub online Jan. 28, 2011, pp. 301-306.*
Wei et al, "Ex Situ Solvent-Assisted Preparation of Magnetic Poly(propylene) Nanocomposites Filled with Fe@FeO Nanoparticles", Micromolecular Materials and Engineering, 2011, 296, pp. 850-857, pub online May 20, 2011.*
Zhu et al, "Surfacnat-free Synthesized Magnetic Polypropylene Nanocomosites: Rheological, Elctrical, Magntic, and Thermal Propeties", Macromolecules, 2011, 44, pp. 4382-4391, pub. May 10, 2011.*
Agag et al., "Studies on thermal and mechanical properties of polyimide-clay nanocomposites," Polymer, 2001, vol. 42, pp. 3399-3408, Jan. 12, 2001.
Auriemma et al., "Crystallization of Metallocene-Made Isotactic Polypropylene: Disordered Modifications Intermediate between α and γ Forms," Macromolecules, 2002, vol. 35, pp. 9057-9068, Oct. 17, 2002.
Ban et al., "The synthesis of core-shell iron@gold nanoparticles and their characterization," J. Mater. Chem., 2005, vol. 15, pp. 4660-4662, Sep. 29, 2005.

(Continued)

*Primary Examiner* — Carol M Koslow
(74) *Attorney, Agent, or Firm* — Kelly Kordzik; Jerry Keys; Matheson Keys & Kordzik PLLC

(57) ABSTRACT

The present invention relates facile method to synthesize magnetic PNCs with highly dispersed and narrow size distributed NPs. The PNCs have highly thermal stability and unique electrical and dielectric properties.

10 Claims, 19 Drawing Sheets

(56) References Cited

OTHER PUBLICATIONS

Barrau et al., "Effect of Palmitic Acid on the Electrical Conductivity of Carbon Nanotubes-Epoxy Resin Composites," Macromolecules, 2003, vol. 36, pp. 9678-9680, Nov. 26, 2003.
Battisha et al., "Synthesis of $Fe_2O_3$ concentrations and sintering temperature on FTIR and magnetic susceptibility measured from 4 to 300 K of monolith silica gel prepared by sol-gel technique," J. Magn. Magn. Mater., 2006, vol. 306, pp. 211-217, Mar. 29, 2006.
Boyer et al., "The stabilization and bio-functionalization of iron oxide nanoparticles using heterotelechelic polymers," J. Mater. Chem., 2009, vol. 19, pp. 111-123, Nov. 11, 2008.
Chen et al., "Poly(propylene)/Carbon Nanofiber Nanocomposites: Ex Situ Solvent-Assisted Preparation and Analysis of Electrical and Electronic Properties," Macromol. Mater. Eng., 2011, vol. 296, pp. 434-443, Jan. 7, 2011.
Dang et al., "Giant Dielectric Permittivities in Functionalized Carbon-Nanotube/Electroactive-Polymer Nanocomposites," Adv. Mater., 2007, vol. 19, pp. 852-857, Feb. 19, 2007.
Du et al., "Nanotube Networks in Polymer Nanocomposites: Rheology and Electrical Conductivity," Macromolecules, 2004, vol. 37, pp. 9048-9055, Nov. 4, 2004.
Fang et al., "High-density $NiTiO_3/TiO_2$ nanotubes synthesized through sol-gel method using well-ordered $TiO_2$ membranes as template," J. Alloys Compd., 2010, vol. 498, pp. 37-41, Mar. 3, 2010.
Foresta et al., "Competition between $\alpha$ and $\gamma$ phases in isotactic polypropylene: effects of ethylene content and nucleating agents at different cooling rates," Polymer, 2001, vol. 42, pp. 1167-1176, Feb. 2001.
Fornes et al., "Crystallization behavior of nylon 6 nanocomposites," Polymer, 2003, vol. 44, pp. 3945-3961, May 23, 2003.
Ge et al., "Assembly of Well-Aligned Multiwalled Carbon Nanotubes in Confined Polyacrylonitrile Environments: Electrospun Composite Nanofiber Sheets," J. Am. Chem. Soc., 2004, vol. 126, pp. 15754-15761, Nov. 10, 2004.
Gu et al., "Single-crystalline $\alpha$-$Fe_2O_3$ with hierarchical structures: Controllable synthesis, formation mechanism and photocatalytic properties," J. Solid State Chem., 2009, vol. 182, pp. 1265-1272, Feb. 12, 2009.
Guo et al., "Fabrication, characterization and microwave properties of polyurethane nanocomposites reinforced with iron oxide and barium titanate nanoparticles," Acta Mater., vol. 57, 2009, pp. 267-277, Oct. 14, 2008.
Guo et al., "Magnetic and magnetoresistance behaviors of particulate iron/vinyl ester resin nanocomposites," J. Phys., 2008, vol. 104, pp. 014314-1-014314-5, Jul. 15, 2008.
Guo et al., "Giant magnetoresistance behavior of an iron/carbonized polyurethane nanocomposite," Appl. Phys. Lett., 2007, vol. 90, pp. 053111-1-053111-3, Feb. 1, 2007.
Guo et al., "Magnetic and electromagnetic evaluation of the magnetic nanoparticle filled polyurethane nanocomposites," J. Appl. Phys., 2007, vol. 101, pp. 09M511-1-09M511-3, May 1, 2007.
Guo et al., "Flexible high-loading particle-reinforced polyurethane magnetic nanocomposite fabrication through particle-surface-initiated polymerization," Nanotechnology, 2007, vol. 18, pp. 1-8, Jul. 25, 2007.
Guo et al., "Surface functionalized alumina nanoparticle filled polymeric nanocomposites with enhanced mechanical properties," J. Mater. Chem., 2006, vol. 16, pp. 2800-2808, Jun. 16, 2006.
Gupta et al., "Synthesis and surface engineering of iron oxide nanoparticles for biomedical applications," Biomaterials, 2005, vol. 26, pp. 3995-4021, Dec. 10, 2004.
Hyun et al., "Rheology of Poly(ethylene oxide)/Organoclay Nanocomposites," Macromolecules, 2001, vol. 34, pp. 8084-8093, Oct. 12, 2001.
Huxtable et al., "Interfacial heat flow in carbon nanotube suspensions," Nat. Mater., 2003, vol. 2, pp. 731-734, Oct. 12, 2003.
Kashiwagi et al., "Nanoparticle networks reduce the flammability of polymer nanocomposites," Nat. Mater., 2005, vol. 4, pp. 928-933, Oct. 23, 2005.
Kataby et al., "Self-Assembled Monolayer Coatings on Amorphous Iron and Iron Oxide Nanoparticles: Thermal Stability and Chemical Reactivity Studies," Langmuir, 1997, vol. 13, pp. 6151-6158, Oct. 1, 1997.
Kim et al., "High Energy Density Nanocomposites Based on Surface-Modified $BaTiO_3$ and a Ferroelectric Polymer," ACS Nano., 2009, vol. 3, No. 9, pp. 2581-2592, Aug. 5, 2009.
Kim et al., "Processing-property relationships of polycarbonate/graphene composites," Polymer, 2009, vol. 50, pp. 3797-3809, May 27, 2009.
Kotsilkova et al., "Reinforcement Effect of Carbon Nanofillers in an Epoxy Resin System: Rheology, Molecular Dynamics, and Mechanical Studies," J. Polym. Sci. Part B Polym. Phys., 2005, vol. 43, pp. 522-533, Jan. 13, 2005.
Kirkpatrick, "Percolation and Conduction," Rev. Mod. Phys., vol. 45, No. 4, pp. 574-588, Oct. 1973.
Kodjie et al, "Morphology and Crystallization Behavior of HDPE/CNT Nanocomposite," J. Macromol. Sci. Part B Phys., 2006, vol. 45, pp. 231-245, Mar. 7, 2006.
Krishnamoorti et al., "Rheology of End-Tethered Polymer Layered Silicate Nanocomposites," Macromolecules, 1997, vol. 30, pp. 4097-4102, Jul. 14, 1997.
Lee et al., "Artificially engineered magnetic nanoparticles for ultra-sensitive molecular imagine," Nat. Med., 2007, vol. 13, No. 1, pp. 95-99, Dec. 24, 2006.
Li et al., "Detection of single micron-sized magnetic bead and magnetic nanoparticles using spin valve sensors for biological applications," J. Appl. Phys., vol. 93, No. 10, pp. 7557-7559, May 15, 2003.
Li et al., "Microstructural Evolution and Magnetic Properties of $NiFe_2O_4$ Nanocrystals Dispersed in Amorphous Silica," Chem. Mater., 2000, vol. 12, pp. 3705-3714, Nov. 22, 2000.
Lu et al., "Modifying the Surface Properties of Superparamagnetic Iron Oxide Nanoparticles through a Sol-Gel Approach," Nano Lett., 2002, vol. 2, No. 3, pp. 183-186, Jan. 11, 2002.
Lu et al., "Magnetic Switch of Permeability for Polyelectrolyte Microcapsules Embedded with Co@Au Nanoparticles," Langmuir, 2005, vol. 21, pp. 2042-2050, Jan. 26, 2005.
Luo et al., "Crystallography of $SiC/MgAl_2O_4/Al$ interfaces in a pre-oxidized SiC reinforced SiC/A1 composite," Acta Mater., 2006, vol. 54, pp. 47-58, Oct. 14, 2005.
Meincke et al., "Mechanical properties and electrical conductivity of carbon-nanotube filled polyamide-6 and its blends with acrylonitrile/butadiene/styrene," Polymer, 2004, vol. 45, pp. 739-748, Dec. 19, 2003.
Oprea et al., "TEM and XRD investigation of $Fe_2O_3$-$Al_2O_3$ system," Ovidius University Annals of Chemistry, vol. 20, No. 2, pp. 222-226, 2009.
McNally et al., "Polyethylene multiwalled carbon nanotube composites," Polymer, 2005, vol. 46, pp. 8222-8232, Jul. 21, 2005.
Mezghani et al., "The $\gamma$-phase of high molecular weight isotactic polypropylene: III. The equilibrium melting point and the phase diagram," Polymer, 1998, vol. 39, No. 16, pp. 3735-3744, Apr. 14, 1999.
Mezghani et al., "$\gamma$-Phase in propylene copolymers at atmospheric pressure," Polymer, 1995, vol. 36, No. 12, pp. 2407-2411, Mar. 16, 2000.
Mikutta et al., "Synthetic coprecipitates of exopolysaccharides and ferrihydrite. Part I: Characterization," Geochimica et Cosmochimica Acta, 2008, vol. 72, pp. 1111-1127, Jan. 24, 2008.
Mitchell et al., "Dispersion of Functionalized Carbon Nanotubes in Polystyrene," Macromolecules, 2002, vol. 35, pp. 8825-8830, Sep. 28, 2002.
Poslinski et al., "Rheological Behavior of Filled Polymeric Systems I. Yield Stress and Shear-Thinning Effects," J. Rheol., vol. 32, No. 7, pp. 703-735, Oct. 1, 1988.
Pötschke et al., "Rheological and dielectrical characterization of melt mixed polycarbonate-multiwalled carbon nanotube composites," Polymer, 2004, vol. 45, pp. 8863-8870, Nov. 5, 2004.
Pötschke et al., "Rheological behavior of multiwalled carbon nanotube/polycarbonate composites," Polymer, 2002, vol. 43, pp. 3247-3255, Mar. 11, 2002.

(56) References Cited

OTHER PUBLICATIONS

Qin et al., "Flame retardant mechanism of polymer/clay nanocomposites based on polypropylene," Polymer, 2005, vol. 46, pp. 8386-8395, Aug. 3, 2005.
Sandler et al., "Ultra-low electrical percolation threshold in carbon-nanotube-epoxy composites," Polymer, 2003, vol. 44, pp. 5893-5899, Jul. 16, 2003.
Shimada et al., "Blue-to-Red Chromatic Sensor Composed of Gold Nanoparticles Conjugated with Thermoresponsive Copolymer for Thiol Sensing," Langmuir, 2007, vol. 23, pp. 11225-11232, Sep. 29, 2007.
Sidorov et al., "Cobalt Nanoparticle Formation in the Pores of Hyper-Cross-Linked Polystyrene: Control of Nanoparticle Growth and Morphology," Chem. Mater., 1999, vol. 11, pp. 3210-3215, Oct. 9, 1999.
Smith et al., "Colloidal Iron Dispersions Prepared via the Polymer-Catalyzed Decomposition of Iron Pentacarbonyl," J. Phys. Chem., 1980, vol. 84, pp. 1621-1629, Jun. 1980.
Sun et al., "Effect of Nanoplatelets on the Rheological Behavior of Epoxy Monomers," Macromol. Mater. Eng., 2009, vol. 294, pp. 103-113, Nov. 18, 2008.
Tasis et al., "Chemistry of Carbon Nanotubes," Chem. Rev., 2006, vol. 106, pp. 1105-1136, Feb. 23, 2006.
Terris et al., "Nanofabricated and self-assembled magnetic structures as data storage media," J. Phys. D: Appl. Phys., 2005, vol. 38, pp. R199-R222, Jun. 3, 2005.
Tseng et al., "Functionalizing Carbon Nanotubes by Plasma Modification for the Preparation of Covalent-Integrated Epoxy Composites," Chem. Mater., 2007, vol. 19, pp. 308-315, Dec. 22, 2006.
Ugaz et al., "Origins of Region I Shear Thinning in Model Lyotropic Liquid Crystalline Polymers," Macromolecules, 1997, vol. 30, pp. 1527-1530, Mar. 10, 1997.
Van Wonterghem et al., "Formation of a Metallic Glass by Thermal Decomposition of $Fe(Co)_5$," Phys. Rev. Lett., vol. 55, No. 4, pp. 410-413, Jul. 22, 1985.
Wang et al., "Superparamagnetic Sub-5 nm Fe@C Nanoparticles: Isolation, Structure, Magnetic Properties, and Directed Assembly," Nano Lett., 2008, vol. 8, No. 11, pp. 3761-3765, Oct. 23, 2008.
Wu et al., "Low-Frequency Internal Friction Study on the Structural Changes in Polymer Melts," Chin. Phys. Lett., 2008, vol. 25, No. 4, pp. 1388-1391, Apr. 2008.
Yang et al., "Direct Formation of Nanohybrid Shish-Kebab in the Injection Molded Bar of Polyethylene/Multiwalled Carbon Nanotubes Composite," Macromolecules, 2009, vol. 42, pp. 7016-7023, Jul. 17, 2009.
Yang et al., "Controlled Synthesis and Novel Solution Rheology of Hyperbranched Poly(urea-urethane)-Functionalized Multiwalled Carbon Nanotubes," Macromolecules, 2007, vol. 40, pp. 5858-5867, Jul. 7, 2007.
Yuan et al., "Impact fracture behavior of clay-reinforced polypropylene nanocomposites," Polymer, 2006, vol. 47, pp. 4421-4433, Apr. 27, 2006.
Zhang et al., "Carbon-stabilized iron nanoparticles for environmental remediation," Nanoscale, 2010, vol. 2, pp. 917-919, May 11, 2010.
Zhu et al., "Enhanced Electrical Switching and Electrochromic Properties of Poly(p-phenylenebenzobisthiazole) Thin Films Embedded with Nano-$WO_3$," Adv. Funct. Mater., 2010, vol. 20, pp. 3076-3084, Aug. 4, 2010.
Zhu et al., "In situ stabilized carbon nanofiber (CNF) reinforced epoxy nanocomposites," J. Mater. Chem., 2010, vol. 20, pp. 4937-4948, May 10, 2010.
Zhu et al., "Magnetic Epoxy Resin Nanocomposites Reinforced with Core-Shell Structured Fe@FeO Nanoparticles: Fabrication and Property Analysis," ACS Appl. Mater. Interfaces, 2010, vol. 2, No. 7, pp. 2100-2107, Jul. 1, 2010.
Zhu et al., "Rheological behaviors and electrical conductivity of epoxy resin nanocomposites suspended with in-situ stabilized carbon nanofibers," Polymer, 2010, vol. 51, pp. 2643-2651, Apr. 18, 2010.
Zhu et al., "Fire Properties of Polystyrene-Clay Nanocomposites," Chem. Mater., 2001, vol. 13, pp. 3774-3780, Apr. 28, 2001.
Zou et al., "ELD—a computer program system for extracting intensities from electron diffraction patterns," Ultramicroscopy, 1993, vol. 49, pp. 147-158, Aug. 28, 2002.

* cited by examiner

SURFACTANT-FREE SYNTHESIS OF MAGNETIC POLYPROPYLENE NANOCOMPOSITES

CROSS-REFERENCE TO RELATED PATENT APPLICATIONS

This application claims priority to: provisional U.S. Patent Application Ser. No. 61/458,827, filed on Dec. 3, 2010, entitled "Surfactant-Free Synthesis Of Magnetic Polyolefin Nanocomposites," which provisional patent application is each commonly assigned to the Assignee of the present invention and is hereby incorporated herein by reference in its entirety for all purposes.

GOVERNMENT INTEREST

This invention was made with government support under Grant DMR-04-49022 awarded by the National Science Foundation. The government has certain rights in the invention.

TECHNICAL FIELD

The present invention relates facile method to synthesize magnetic PNCs with highly dispersed and narrow size distributed NPs. The PNCs have highly thermal stability and unique electrical and dielectric properties.

BACKGROUND

Over the past few decades, magnetic materials with various shapes and sizes have demonstrated wide potential applications, for examples, in data storage [Wang 2008, Terris 2005], magnetic sensors [Li 2003, Guo 2007, Guo 2008], biomedical [Lee 2007, Lu 2005] (i.e., drug delivery) and pharmaceutical areas [Ban 2005, Gupta 2004], and even the environmental remediation [Zang 2010]. Polymer nanocomposites (PNCs) have been well developed in the last two decades due to the combined advantages of polymers, such as lightweight, easy processability and flexibility, and excellent physiochemical characteristics of the inorganic nanomaterials such as high mechanical strength and excellent electrical, magnetic and optical properties. Therefore, magnetic PNCs have attracted wide interest for their diverse potential applications such as energy storage devices [Kim, P. 2009], electrochromic devices [Zhu 2010], electronics [Zhu 2010 II, Zhu 2010 III], microwave absorbers [Guo 2007 II, Guo 2009], and sensors [Shimada 2007].

The major challenge lying ahead to obtain high performance PNCs comes from the serious agglomeration of the nanomaterials owing to their high surface energy and large specific surface area. Thus, a lot of efforts have been made to tailor their surface property through physical and chemical approaches [Tseng 2006, Tasis 2006, Yang 2007, Guo 2006] to improve the interfacial compatibility between the inorganic fillers and the polymermatrix. To overcome the challenges in dispersing the magnetic nanoparticles (NPs) limited by the magnetically induced agglomeration, techniques including encapsulating the magnetic core with surfactant [Kataby 1997], polymer [Boyer 2009], silica [Lu 2002], and carbon [Zhang 2010] have been reported. However, these well-dispersed NPs can only be limitedly applied in specific polymers with versatile surface functionalities. Right now, most of the current research work on fabricating PNCs starts from the as-prepared NPs and polymers (or monomer) with a direct blending [Zhu 2010 III] or surface initiated polymerization method [Gun 2007 III]. A general method is of great interest to simplify the procedures while maintaining the well dispersed magnetic NPs.

The critical concentration of the fillers within the polymer matrix, where the performance of the PNCs experiences a sharp change, is often called "percolation threshold." Almost all the physical properties, including viscoelastic, thermal, mechanical and electrical properties are related to the percolation phenomenon. Thus, various methods have been developed to determine the percolation value. Most of the current research efforts concentrate on the carbon based nanomaterials such as carbon nanotubes (CNTs) [Potschke 2002], carbon nanofibers [Zhu 2010 II, Zhu 2010 IV], carbon NPs [Kotsilkova 2005], and graphene [Kim, H. 2009] to enhance the thermal, electrical and mechanical properties of the polymers. Nanoclays [Sun 2009, Hyun 2001] are often used to improve the fire retardant performance. Potschke et al. [Potschke 2004] studied the rheological and dielectric percolation of the multiwalled CNTs/polycarbonate PNCs and found that the rheological percolation (0.5-5 wt %) is strongly dependent on the temperature and the electrical percolation is at about 1 wt %. Sandler et al. [Sandler 2003] reported a ultra low electrical percolation in the CNTs/epoxy PNCs at a loading of 0.0025 wt %. It is well-known that the percolation threshold is also dependent on the filler morphology, spherical particles are relatively difficult to reach percolation as compared to those with larger aspect ratio (like fibers and tubes). Therefore, a relatively higher loading of around 16 vol % from geometrical model [Kirkpatrick 1973, Zallen 1983] was required to reach percolation. Recently, Zhu et al. reported a low electrical percolation at 1.5 vol % with spherical Fe(core)-FeO(shell) structured NPs in epoxy resin using a surface wetting method. [Zhu 2010 111].

SUMMARY OF THE INVENTION

The present invention relates to an in-situ method to fabricate magnetic PNCs with highly dispersed and narrow size distributed NPs. No surfactant need be used in the whole process. The thermal stability of the PNCs increased surprisingly by ~120° C. with various particle loadings (3-12 wt %). In embodiments of the present invention, the composites showed conductive behavior when the NPs loading was higher than 5 wt %. And the dielectric constant was found to reach 100-1000 depending on the frequency, which would be of great interest in super-capacitor applications.

A facile surfactant-free process has been utilized to prepare multifunctional polypropylene (PP) nanocomposites filled with highly dispersed $Fe@Fe_2O_3$ core@shell nanoparticles (NPs). Transmission electron microscopy (TEM) observations confirmed the formation of uniform NPs in the PP matrix and the particle size increased with increasing the particle loading. The melt rheology measurements showed an apparent change in the frequency dependent storage modulus (G'), loss modulus (G"), and complex viscosity ($\eta^*$) particularly at low frequencies. These changes were often related to the filler "percolation threshold," which has also been verified in the sharp change of electrical resistance and dielectric permittivity of these nanocomposites in higher particle loadings. The continuous decrease in the resistivity with increasing filler loading from 5 wt % to 20 wt % demonstrated the structural transition of the nanocomposites. The monotonic increase in the dielectric permittivity with increasing particle loadings combined with the direct evidence from the TEM observations indicated that the NPs are well separated and uniformly dispersed in the polymer matrix. Thermal gravimetric analysis (TGA) results revealed a surprisingly high enhancement of the thermal stability by ~120° C. in air due to the oxygen trapping effect of the NPs and the polymer-particle interfacial interaction. The differential scanning calorimetry (DSC) results showed that the crystalline temperature ($T_c$) of the nanocomposites was reduced by 16-18° C. as compared to that of PP, while the melting temperature ($T_m$) almost maintained the same. The nanocomposites were found to be soft ferromagnetic at room temperature.

In general, in one aspect, the invention features a method that includes forming a solution that includes a nanoparticle precursor, a polypropylene, and a solvent. The solution is surfactant-free. The method further includes synthesizing the solution to form a magnetic polypropylene nanocomposite. The synthesis is a surfactant-free synthesis.

In general, in another aspect, the invention features a composition that includes polypropylene and nanoparticles. In the composition, the nanoparticles are wrapped by the polypropylene. The composition is a magnetic polypropylene nanocomposite.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

DETAILED DESCRIPTION

Figure 1A:
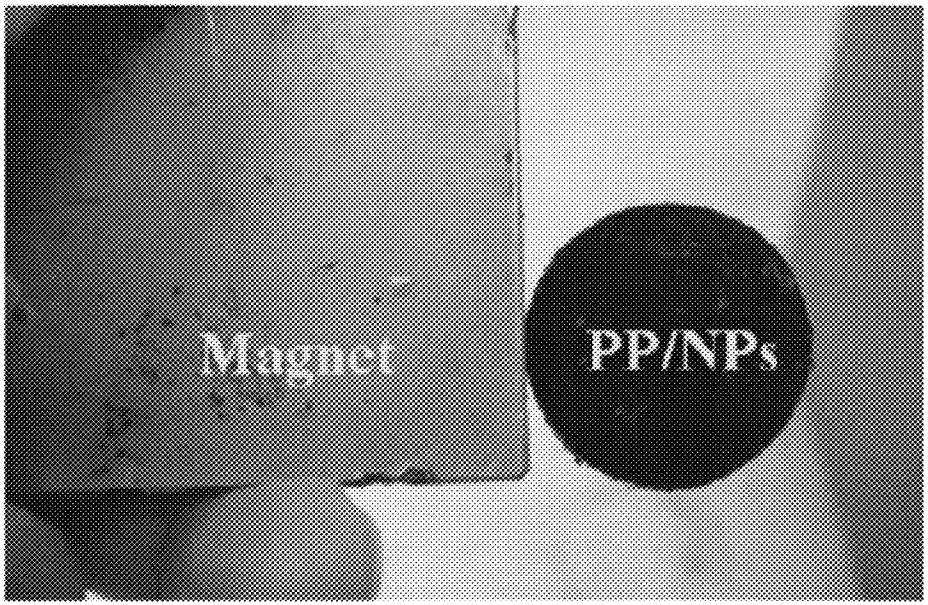
FIG. 1A is a photograph of a prepared magnetic nanocomposite sample of the present invention attached to a magnet.

A facile in situ surfactant free method to synthesize magnetic polyolefin polypropylene (PP) nanocomposites has been discovered. In an embodiment of the present invention, magnetic NPs can be produced using $Fe(CO)_5$ as a precursor during the refluxing process in the $Fe(CO)_5$/PP/xylene solution. The as-synthesized NPs are physically wrapped by PP. The composition has unique rheological, electrical, and dielectric percolation behaviors.

In the examples illustrated herein, the following materials were utilized:

Isotactic PP (Total Petrochemicals Inc. USA), (0.9 g/cm3 in density, Mn≈40500, Mw≈155000, melt index≈35 g/min).

Iron(0) pentacarbonyl (iron carbonyl, Fe(CO)5, 99%) (Sigma-Aldrich).

Solvent xylene (laboratory grade, F=0.87 g/cm3) with a boiling temperature ranging from 137 to 145° C. (Fisher Scientific).

All the chemicals were used as received without any treatment.

Fabrication of Polymer Nanocomposites.

In an embodiment of the present invention, PP was initially dissolved in xylene with a weight ratio of 1:10 (20 g: 207 mL) and refluxed at the boiling point (~140° C.) of xylene for around 2 hour until the PP was completely dissolved. Then different weight (2.17, 3.67, 6.08, 9.54, and 17.48 g) of liquid $Fe(CO)_5$ was injected into the dissolved PP solution to obtain the final PNCs containing 3, 5, 8, 12, and 20 wt % of the NPs (based on pure iron element). The mixture solution turned from transparent to yellow immediately after the addition of $Fe(CO)_5$ and then gradually changed to black during the additional 3 hour refluxing process under the nitrogen protecting conditions, indicating the formation of the NPs. The PNC solution was then cooled down to around 90° C. and then poured onto a large glass plate to allow solvent evaporation overnight. The powder-like products were collected and kept in a vacuum oven at room temperature overnight.

Pure PP powders are also prepared following the above procedures without adding $Fe(CO)_5$ and are termed as p-PP to differentiate from the as-received PP (o-PP). Upon heating, $Fe(CO)_5$ was decomposed to $Fe_2(CO)_9$ and $Fe_3$-$(CO)_{12}$ with a rapid formation of CO, reaching an equilibrium mixture of all the three carbonyls. The $Fe_3(CO)_{12}$ was then decomposed and finally formed the metallic NPs [Smith 1980, Van Wonterghem 1985]. Oxidization took place on the surface and then a core-shell structure was formed after exposure to air.

Figure 1B:
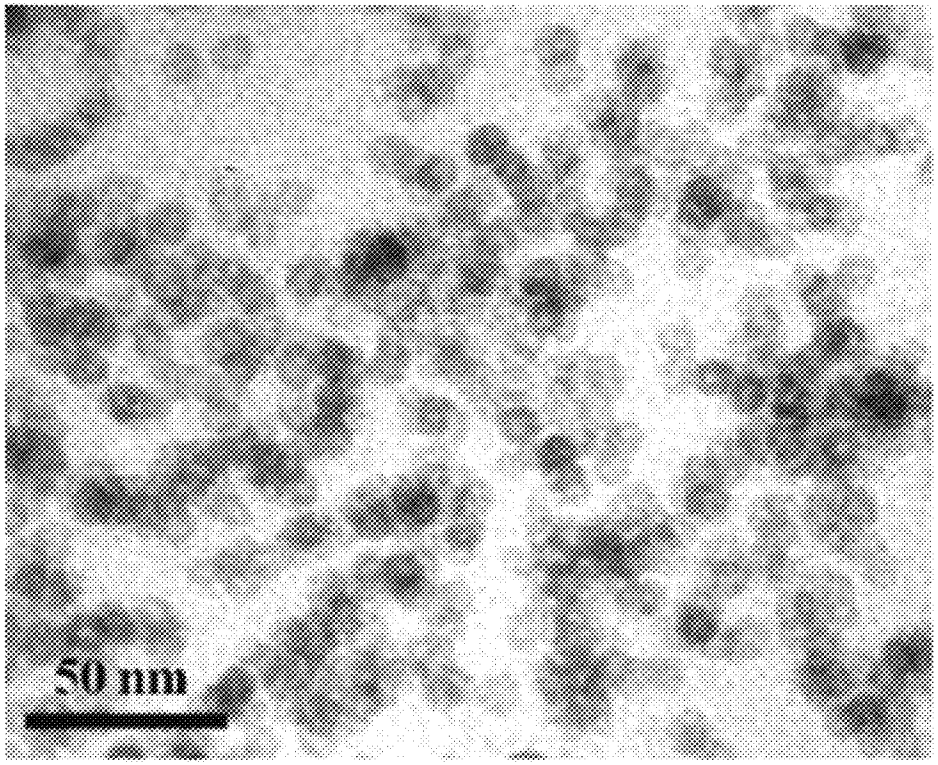
FIG. 1B is a TEM image of an embodiment of the present invention having an NPs loading of 8 wt %.

The desired samples were prepared from PP both the as-received original PP (o-PP) and processed PP (p-PP) and its PNC powders using hot press (Carver 3853-0, USA). Briefly, the dried powders were compressed under a pressure of 10 MPa at 180° C. in a mold at a heating rate of 20° C./min. The compressed composites were held at 180° C. for 20 min and then cooled down to room temperature in the mold while maintaining the applied pressure. Finally, a disk-shaped nanocomposite sample was prepared with a diameter of 25 mm and thickness of 2-3 mm. FIG. 1A shows the prepared PNCs magnetically attracted by a magnet. FIG. 1B is PNCs with an NPs loading of 8 wt %.

Characterization

Fourier transform infrared spectroscopy (FT-IR, Bruker Inc. Tensor 27) with hyperion 1000 ATR microscopy accessory was used to characterize PP and its PNCs over the range of 2500 to 400 $cm^{-1}$ at a resolution of 4 $cm^{-1}$. The X-ray diffraction (XRD) analysis with Cu radiation source was carried out with a STA Jupiter 449C (Netzsch) on disk samples with a diameter of 25 mm.

The particle distribution in the PP matrix was examined by a transmission electron microscope (TEM). The samples were stained in RuO4 vapor to harden the surface and then microtomed into a film with a thickness of ~100 nm, which were observed in a JEOL 2010 TEM at a working voltage of 200 kV. Images were recorded with a Gatan Orius SC 1000 CCD camera. In order to obtain more accurate particle size, magnifications were calibrated using commercial cross-line grating replica and SiC lattice images.[Luo 2006].

The rheological behavior of the PNCs was studied using TA Instruments AR 2000ex Rheometer. An environmental test chamber (ETC) steel parallel-plate geometry (25 mm in diameter) was used to perform the measurement at 200° C., with dynamic oscillation frequency sweeping from 100 to 0.1 Hz in the linear viscoelastic (LVE) range (strain 1%) under a nitrogen atmosphere to prevent the oxidation of PP.

The thermal degradation/stability of the PNCs was studied with a thermogravimetric analysis (TGA, TA Instruments TGA Q-500) from 25 to 600° C. in air and nitrogen atmosphere, respectively, with a flow rate of 60 mL/min and a heating rate of 10° C./min. Differential scanning calorimeter (DSC, TA Instruments Q2000) measurements were carried out from 0 to 250° C. under a nitrogen flow rate of approximately 100 mL/min at a heating rate of 10° C./min.

The volume resistivity was determined by measuring the DC resistance on a disk-shaped sample (diameter, ~50 mm; thickness, 0.5-1.0 mm). An Agilent 4339B high resistance meter equipped with a resistivity cell (Agilent, 16008B) was used to measure the volume resistivity of each sample after inputting the thickness. This equipment allowed the resistivity measurement up to 1016Ω. The source voltage was set at 0.1 V for all the samples. The reported values represent the mean value of eight measurements with a deviation less than 10%.

The dielectric properties were measured by a LCR meter (Agilent, E4980A) equipped with a dielectric test fixture (Agilent, 16451B) at the frequency of 20 HZ-2 MHz. The PP and PNCs were hot pressed in the form of disk pellets with a diameter of 60 mm and an average thickness of about 0.7 mm.

The magnetic property measurements of the PNCs with various particle loadings were carried out in a 9 T physical properties measurement system (PPMS) by Quantum Design at room temperature.

FT-IR Analysis

Figure 2:
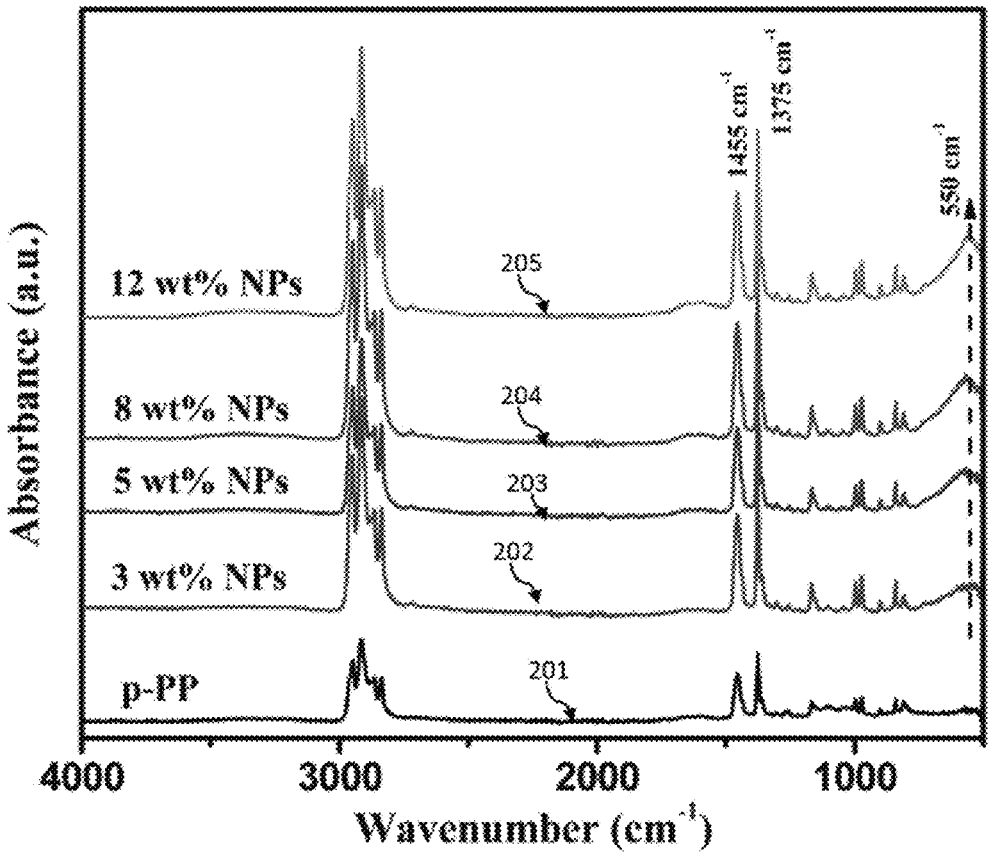
FIG. 2 is a graph of the FT-IR spectra of p-PP and its PNCs with different particle loadings.

FIG. 2 shows the FT-IR spectra of pure PP (201) and its PNCs (3, 5, 8, and 12 wt % at 202-205, respectively). The absorption peaks at 1455 and 1375 $cm^{-1}$ were attributed to the C-H bending vibration of the polymer matrix, and the multi peaks near 3000 $cm^{-1}$ were assigned to the C-H stretching vibration. [Qin 2005] These characteristic peaks were well maintained in all the PNC samples, indicating that the polymer structure was not changed in the PNCs fabricated by this in situ thermo-decomposition method. A new broad peak at around 550 $cm^{-1}$ corresponding to the vibration Fe-0 modes [Li 2000, Battisha 2006] in $Fe_2O_3$ was observed. The peak strength became more intense with increasing particle loading with respect to the other peaks in each FT-IR curve, which was due to the presence of more NPs in the polymer matrix with an increased particle loading.

Microstructure of PNCs and Electron Diffraction of NPs

FIGS. 3A-3H shows the TEM micrographs of the PNCs containing 5, 8, and 20 wt % NPs at two different magnifications. The NPs were observed to be uniformly distributed in the polymer matrix and the particle size was well controlled, demonstrating that this in situ method was effective to synthesize PNCs with highly uniform NPs.

The measured particle size (FIGS. 3B, 3D, and 3F) increased gradually with increasing particle loading. The average particle diameter is 8.2±1.2, 11.0±0.9, and 15.9±2.2 nm for PNCs reinforced with a particle loading of 5, 8, and 20 wt %, respectively. In most cases, the particle size is governed by the rates of nucleation and growth. [Sidorov 1999]. Since the same precursor and synthesis procedures were used during the preparation of different PNCs in these embodiments, the nucleation rate should be the same. The larger particle size obtained at higher loading was due to the growth of more concentrated nucleates in the unit volume.

Figure 3A:
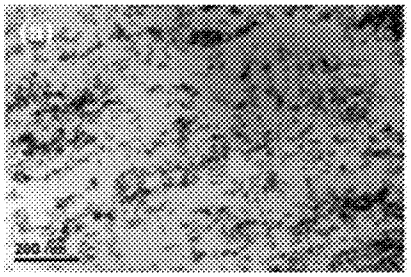
FIGS. 3A-3H are TEM images of PNCs with a particle loading of 5 (3A and 3B), 8 (3C and 3D), and 20 wt % (3E and 3F); HRTEM (3G) and SAED pattern (3H) of the NPs.
Figure 3B:
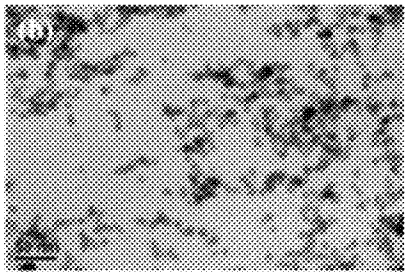
Figure 3C:
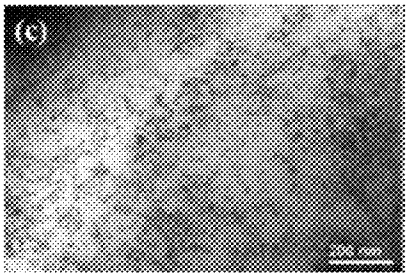
Figure 3D:
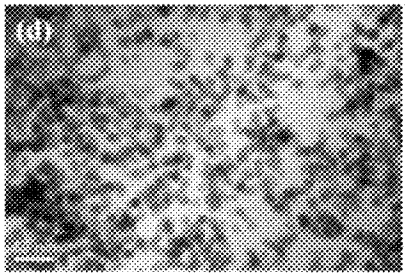
Figure 3E:
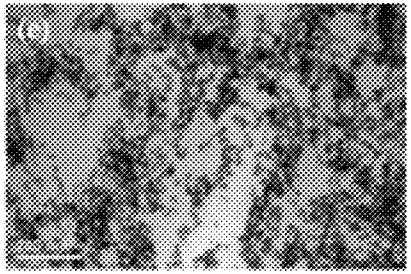
Figure 3F:
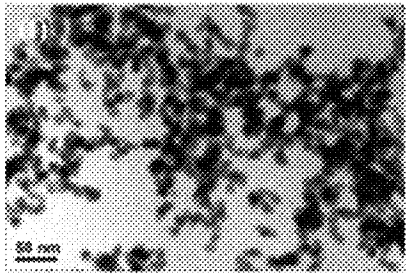
Figure 3G:
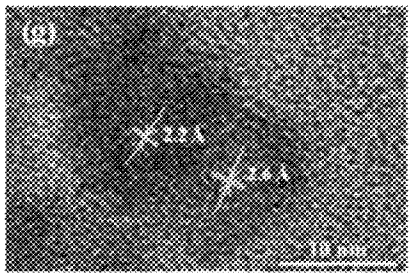
Figure 3H:
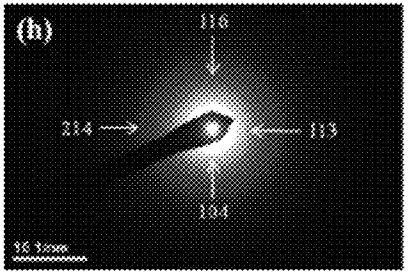

To obtain the phase structure of the formed NPs, the NPs were characterized by high resolution TEM (HRTEM), as shown in FIG. 3G. The fringe spacing is about 2.60 and 2.20 Å, corresponding to the (104) and (113) crystal planes of $Fe_2O_3$. The corresponding selected area electron diffraction (SAED) pattern is presented in FIG. 3H. The rings with plane distances of 2.60, 2.20, 1.70, and 1.39 Å were observed, which fit well with the (104), (113), (116), and (214) diffraction planes for the trigonal phase of $Fe_2O_3$.[Gu 2009, Oprea 2009].

The percolation (or called threshold), which is essentially important for the prediction and interpretation of the switching physical phenomena, can be observed from the particle-particle interaction within the polymer matrix. Once a network structure of the filler was formed in the composites, the electrical [Zhu 2010 II, Barrau 2003], rheological [Zhu 2010 IV] and mechanical properties [Meincke 2004] experienced a sharp change. The PNCs with the particle loading increasing from 5 to 20 wt % illustrate the structural transition of the NPs within the polymer matrix. For 5 wt % loading, the NPs were loosely embedded in the matrix, though continuous network structure could not be observed, the string-like particle chain began to form, FIG. 3A. When the loading increased to 8 wt %, the NPs were distributed more densely and the particle-particle distance was significantly reduced. The network structure of the NPs was completely formed as the loading reached 20 wt %, meanwhile some agglomerates were observed due to the high particle packaging density in the unit volume.

X-ray Diffraction and Mossbauer Analysis

Figure 4:
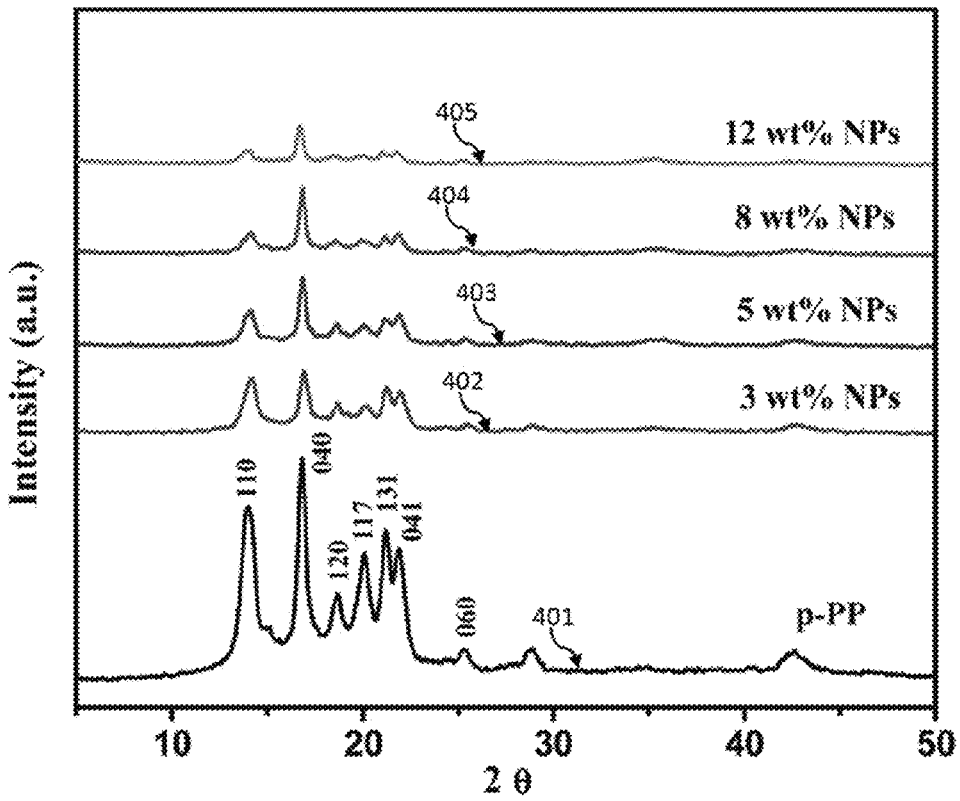
FIG. 4 is a graph of the X-ray diffraction patterns for p-PP and its PNCs.

Despite the simplicity of its chemical component, PP showed a remarkable complexity of crystal structures (phases), which include α, β, and γ phases. Each of the α, β, and γ crystalline form had its own distinctive peaks in the XRD patterns. FIG. 4 shows the XRD profiles of PP (401) and its PNCs (3, 5, 8, and 12 wt % at 402-405, respectively). It is evident that the peak intensity decreased gradually with increasing particle loading, which was attributed to the decreased crystalline size of PP after introducing the NPs (the crystallinity was almost maintained from the DSC analysis, see Table 1 below).

TABLE1

DSC Characteristics of p-PP and Its PNCs

| Material | $T_m$ (° C.) | $\Delta H_m$ (J/g) | $T_c$ (° C.) | $\Delta H_c$ (J/g) | $F_c$ (%) |
|---|---|---|---|---|---|
| p-PP | 149.2 | 90.4 | 119.8 | 86.6 | 43.3 |
| 3 wt% NPs | 148.6 | 80.8 | 103.4 | 83.0 | 39.9 |
| 5 wt% NPs | 149.1 | 86.7 | 101.6 | 89.1 | 43.6 |
| 8 wt% NPs | 148.1 | 63.8 | 101.3 | 66.4 | 42.9 |
| 12 wt% NPs | 149.3 | 67.5 | 101.3 | 66.8 | 36.7 |

In a typical XRD pattern of the R phase PP, the intensity of the first peak (110) was always stronger than that of the second peak (040).[Auriemma 2002]. However, it was not true for the samples containing γ phase. All the samples were characterized by a stronger second peak than that of the first one, which was not surprising considering the same location of the strong peak in γ phase. Because of the high diffraction similarity between R and γ phases in the region of 13-17°, the γ phase was usually determined from the peak at 2θ=20.07° (117), and R phase is identified from the peak 2θ=18.50° (120). [Forester 2001] The other peaks at 2θ=14.06, 16.90, 21.20, and 21.86° corresponded to the 110, 040, 131, and 041 crystalline planes of R-PP, respectively. It was interesting to observe that the peak intensity at 2θ=20.07° decreased with the addition of the NPs. However, the amount of γ-PP showed a surprisingly filler loading independent behavior and a comparable peak intensity at 2θ=20.07° was observed as compared to that of the peak at 2θ=18.50°. In a previous study [Mezghani 1995], the ratio of γ to α was simply calculated from the relative intensity of the unique peaks of γ phase at 2θ=20.07° and a phase at 2θ=18.50°. The relatively low intensity of the peak at 20.07° as compared to that of the peak at 18.50° after the incorporation of the NPs suggested a reduced amount of γ phase during the crystallization process. Earlier studies showed that more PP was observed to be crystallized in the γ phase at a lower cooling rate.[Mezghani 1998]. In this embodiment of the present invention, the conductive fillers within the polymer matrix created a pathway for heat transfer and the cooling rate was much faster for the PNCs as compared to that of pure PP, which was observed in the CNTs suspended in surfactant micelles in water. [Huxtable 2003]. Therefore, a decreased amount of PP in γ phase was observed.

However, no additional peak regarding the NPs was detected in the PNCs as compared with those of pure PP, which is due to the limitation of the XRD whose signals only come from the sample surface. The crystalline structure of the NPs was further identified from the comparison between the experimental and simulated TEM-SAED patterns. Mossbauer analysis was also used to justify the valence of iron in the NPs.

Figure 5B:
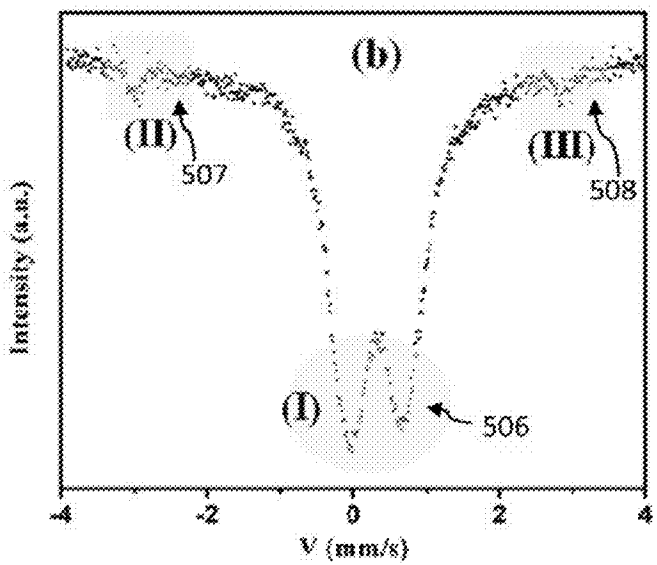
FIG. 5B is a graph of the Mossbauer spectra of the PNCs with particle loading of 20 wt %.
Figure 5A:
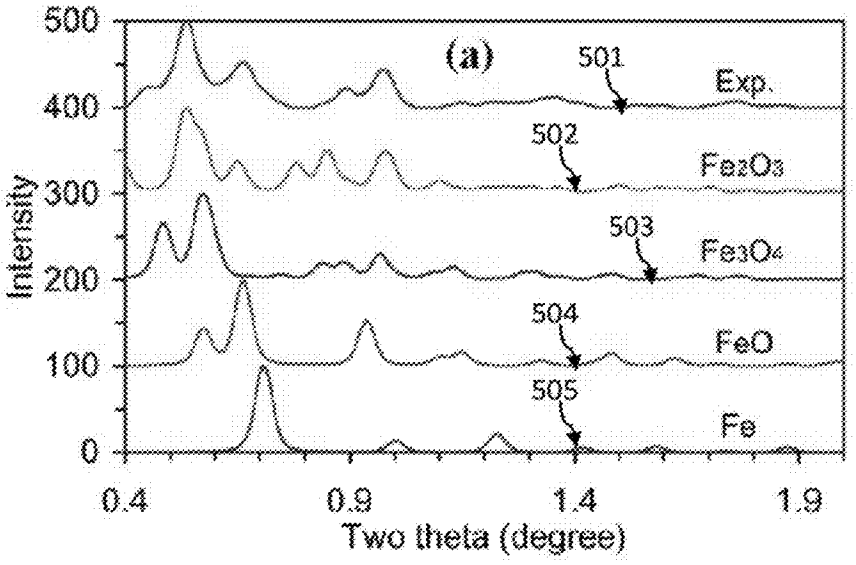
FIG. 5A is a graph of the the experimental and simulation results of the NPs from TEM-SAED patterns.

The particle composition is examined by the consistence between the experimental and simulation results based on the SAED data. [Fang 2010]. To be specific, the intensity profile of the SAED pattern was measured using ELD program [Zou 1993] and the background of the intensity profile was subtracted using Reflex module in MS Modeling program.[Fang 2010]. Then the simulated SAED powder patterns were calculated using the standard structures of $Fe_2O_3$, $Fe_3O_4$, FeO and Fe. As shown in FIG. 5A, In comparison with the peak position and intensities, $Fe_2O_3$ fit the experimental observation the best. FIG. 5A is a graph of the experimental (501) and simulation results of the NPs from TEM-SAED patterns (502-505 for $Fe_2O_3$, $Fe_3O_4$, FeO and Fe, respectively).

However, there was still a difference between the experimental curve and the standard simulated $Fe_2O_3$ pattern. To further confirm the particle composition, room temperature Mossbauer spectrum analysis was conducted on the PNCs with a particle loading of 20 wt %, as shown in FIG. 5B. The paramagnetic doublet observed in the center of the Mossbauer spectra I (506), confirmed the existence of $Fe^{3+}$, which corresponds to the superparamagnetic behavior of $Fe_2O_3$. [Mikutta 2008]. The fitting results showed a main component at isomer shift (IS)=0.35 mm/s and quadrupole splitting (QS)=0.80 mm/s, which is $Fe^{3+}$ in a paramagnetic state in the distorted oxygen octahedral site. II (507) and III (508) of FIG. 5B depicts the secondary component with IS=0 and correspondent H=335 kOe, which represents a spectral contribution of 5% α-Fe metallic magnetically ordered state. The aforementioned analysis justified that the formed NPs have a chemical structure of Fe core and $Fe_2O_3$ shell.

Melt Rheology

Figure 6:
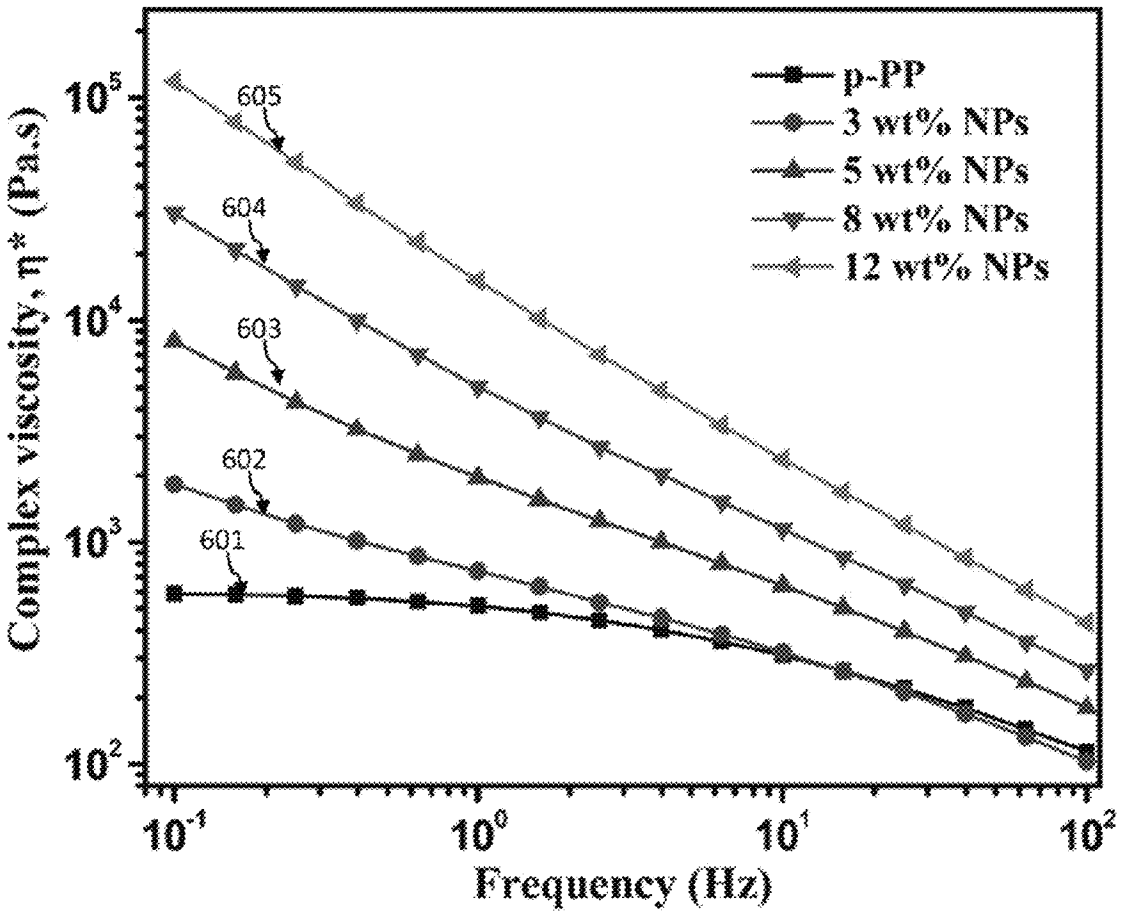
FIG. 6 is a graph of the complex viscosity ($\eta^*$) as a function of frequency for PP and its PNCs.

The rheological behaviors of the composite melts are essentially important for industrial nanocomposite processing. Also, the formation of a percolated system can be detected by characterizing the complex viscosity (η*), storage modulus (G'), and loss modulus (G") as a function of frequency. [Zhu 2010 II, Zhu 2010 IV, Potschke 2004, Mitchell 2002]. FIG. 6 shows the variation of η* with frequency for pure PP (601) and its PNCs (3, 5, 8, and 12 wt % at 602-605, respectively) measured at 200° C. η* increased with increasing the particle loading, especially at low frequency such as 0.1 Hz. Pure PP was observed to have frequency independent fluid properties, i.e., Newtonian-type flow only within the range of 0.1-0.4 Hz and shear thinning (viscosity decreased with an increase of shear rate/frequency) dominated the melt thereafter until 100 Hz. [Poslinski 1988, Ugaz 1997]. The PNCs with a particle loading of 3 wt % were much more viscous than that of pure PP at low frequencies and exhibited strong shear thinning behavior. The similar value of η* at high frequency (10-100 Hz) indicated a polymer melt rather than filler dominated fluid dynamics. However, as the particle loading increased to 5, 8, and 12 wt %, the viscosity curve became linear within the whole frequency range. This phenomenon indicated a filler dominated fluid in the PNCs with a relatively high particle loading. The transition in η* indicated that the PNCs had reached a rheological percolation, at which the NPs form a network structure and greatly impede the motion of the polymer chains. The increase of η* with an increase of particle loadings was primarily due to the significant increase in G' and G" ($\eta^*=\eta 0'-i\eta''$, where $\eta'=G''/\omega$, $\eta''=G'/\omega$, and ω is angular frequency, rad/s). [Shenoy 1999].

Figure 7A:
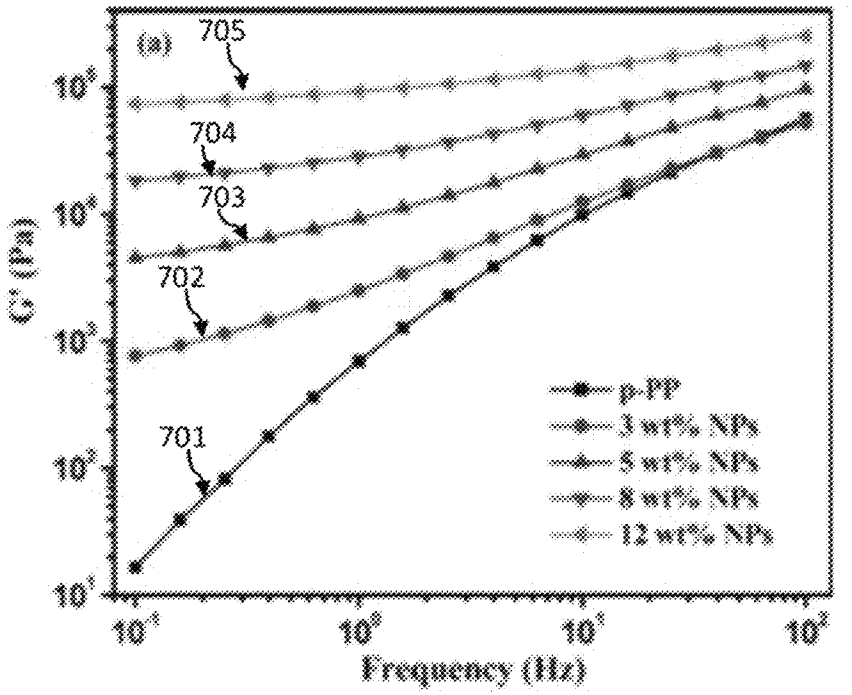
FIGS. 7A-7C are graphs of (7A) storage modulus (G'), (7B) loss modulus (G"), and (7C) tan δ as a function of frequency for PP and its PNCs (with the peak position marked with arrow).
Figure 7B:
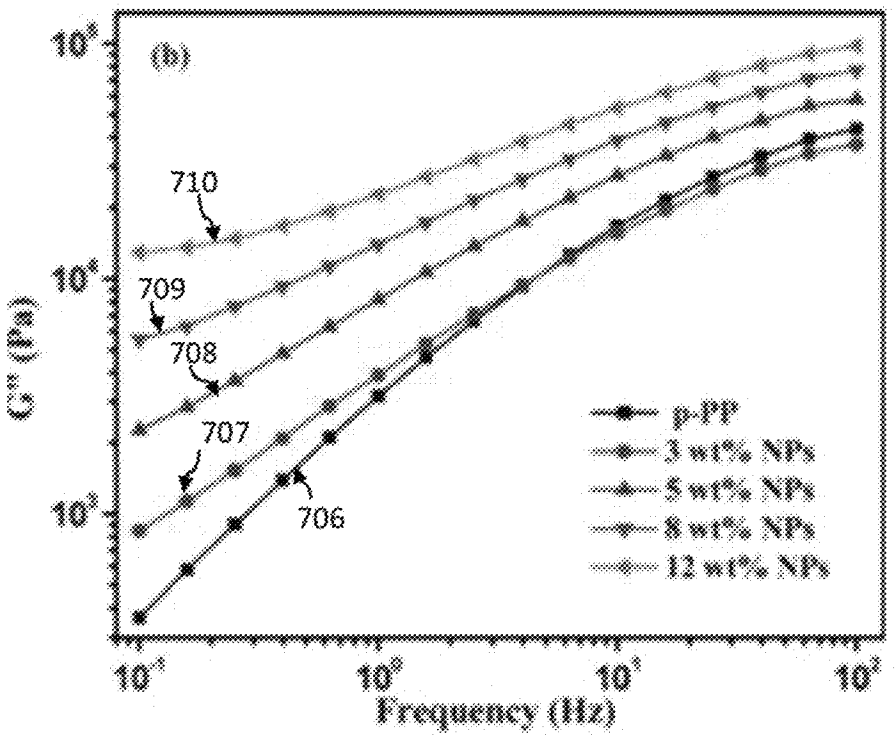

At 200° C., the PP chains were fully relaxed and exhibited a typical homopolymer-like terminal behavior, which disappeared with the addition of the NPs. As shown in FIG. 7A, G' increased monotonically with increasing the particle loading at all frequencies (pure PP (701) and its PNCs (3, 5, 8, and 12 wt % at 702-705, respectively). Larger enhancement of G' with orders of magnitude was observed at lower frequencies for the PNCs, which indicated that the large-scale polymer chain relaxations in the PNCs were significantly restrained by the presence of the NPs. The G' versus frequency curve for the PNCs with relatively higher particle loadings (≥5 wt %) approached a plateau at low frequencies. This "plateau" with a nonterminal low-frequency behavior [Du 2004] suggested either an interconnected structure of the fillers or a strong particle-polymer interaction. [Potschke 2004]. Similar low frequency response was also observed in the conventional composites. [Krishnamoorti 1997, McNally 2005]. At high frequencies, the effect of the particle loading on the rheological behavior was relatively weak. This phenomenon indicated that the NPs were not effective to affect the short-range dynamics of the PP chains. [Du 2004]. As shown in FIG. 7B, a similar curve of the G" (pure PP (706) and its PNCs (3, 5, 8, and 12 wt % at 707-710, respectively) with increasing frequency was observed. The plateau was observed in the PNCs with higher particle loading (≥8 wt %).

Figure 7C:
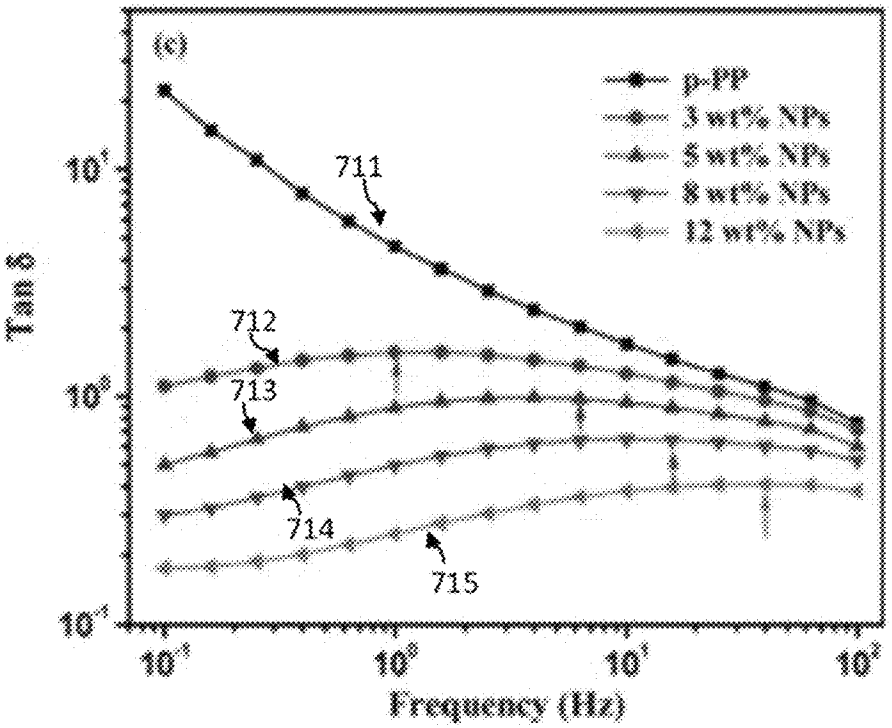

The tan 8 is the ratio of G00 to G0, which was used to characterize the damping property of the PNCs. As shown in FIG. 7C G" (pure PP (711) and its PNCs (3, 5, 8, and 12 wt % at 712-715, respectively), it is evident that tan δ decreased and the corresponding curves became flatter with increasing particle loading. The mechanical loss, which was arising from the discordance between strain and stress in the polymer exposed to an external force [Wu 2008], was strongly related to the applied frequency. The tan δ of pure PP decreased monotonously, while a peak is observed in all the PNC samples (with the peak position marked with arrow for each of 712-715). The higher tan δ of pure PP than that of the PNCs was due to the fully relaxation of the PP chains, which made the interpolymer-chain motion more difficult and more interchain friction heat was generated during the oscillation. After incorporating the NPs, the polymer chain relaxation and relative motion have been greatly restrained by the presence of the NPs and the PNCs are "stiffer". Therefore, less internal chain-chain friction heat was produced upon applying the same oscillation frequency. In addition, the higher the particle loading, the lower tan δ was observed. This observation suggested a strong interaction between the NPs and the polymer matrix, both energy dissipation and relaxation of the PP chains were increasingly hindered as the particle loading increased. For the PNCs, a broad peak appeared on each tan δ curve and the peak position shifts to higher frequency with increasing nanoparticle loading due to the greater restrictions. At low frequency, the polymer chain motion kept in step with the oscillation and the internal friction among the polymer chains would be neglected. Once the frequency went to extremely high, the movement of the polymer chains was not able to catch up the variation of the frequency. Therefore, the PNCs behaved like glass state and generated small amount of energy loss. Large amount of energy loss appeared between these two extreme conditions when the polymer showed viscoelastic properties. [Bower 2002]. Similar phenomena have been observed in the PP/carbon nanofiber nanocomposites. [Chen].

Figure 8:
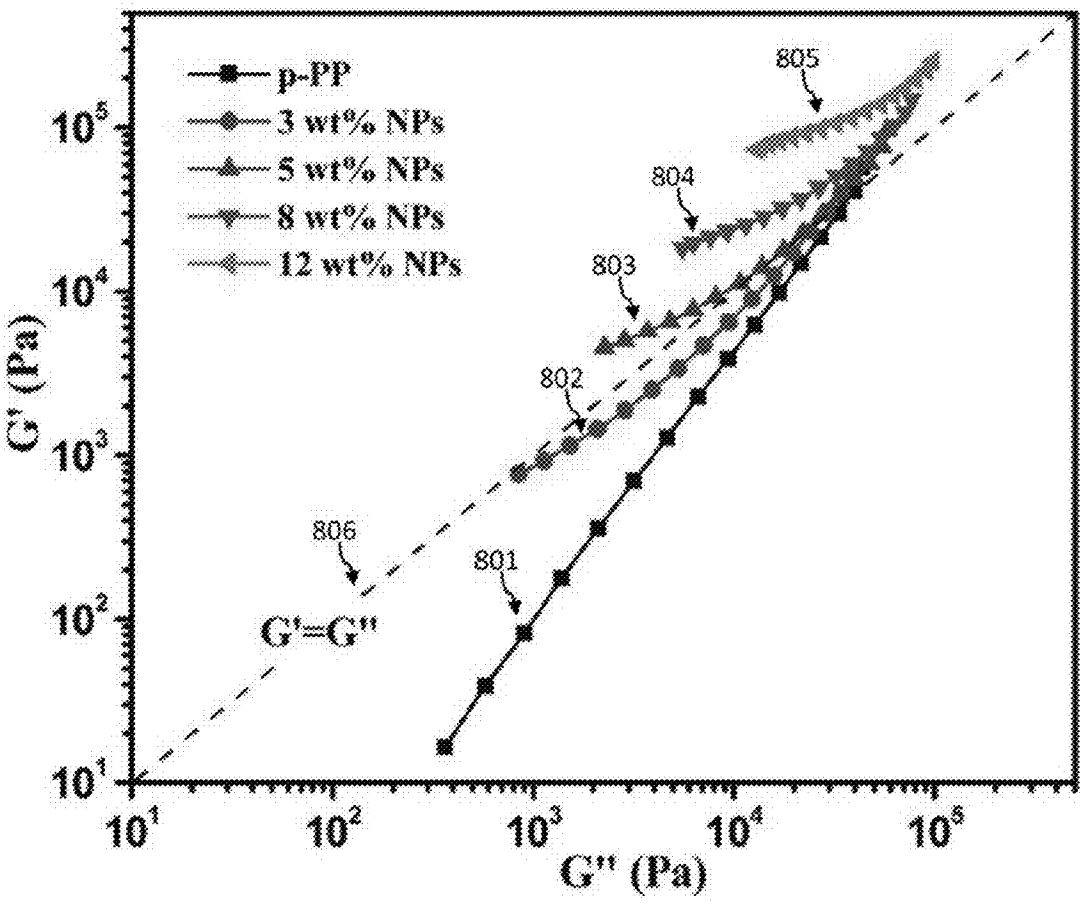
FIG. 8 is a graph of the storage modulus (G') as a function of loss modulus (G") for PP and its PNCs.

G' versus G" for the PP and its PNCs is plotted in FIG. 8 (pure PP (801) and its PNCs (3, 5, 8, and 12 wt % at 802-805, respectively; the line where G'=G" is shown as line 806). Generally, G' increased with the increase of G". The structural difference of each composite could be monitored from the slope change of the curves. The gradually decreased slope evidenced the structural change as the particle loading increased, which was also observed in the MWCNT reinforced polycarbonate [Potschke 2004] and polyethylene [McNally 2005] PNCs.

Electrical Conductivity

Figure 9:
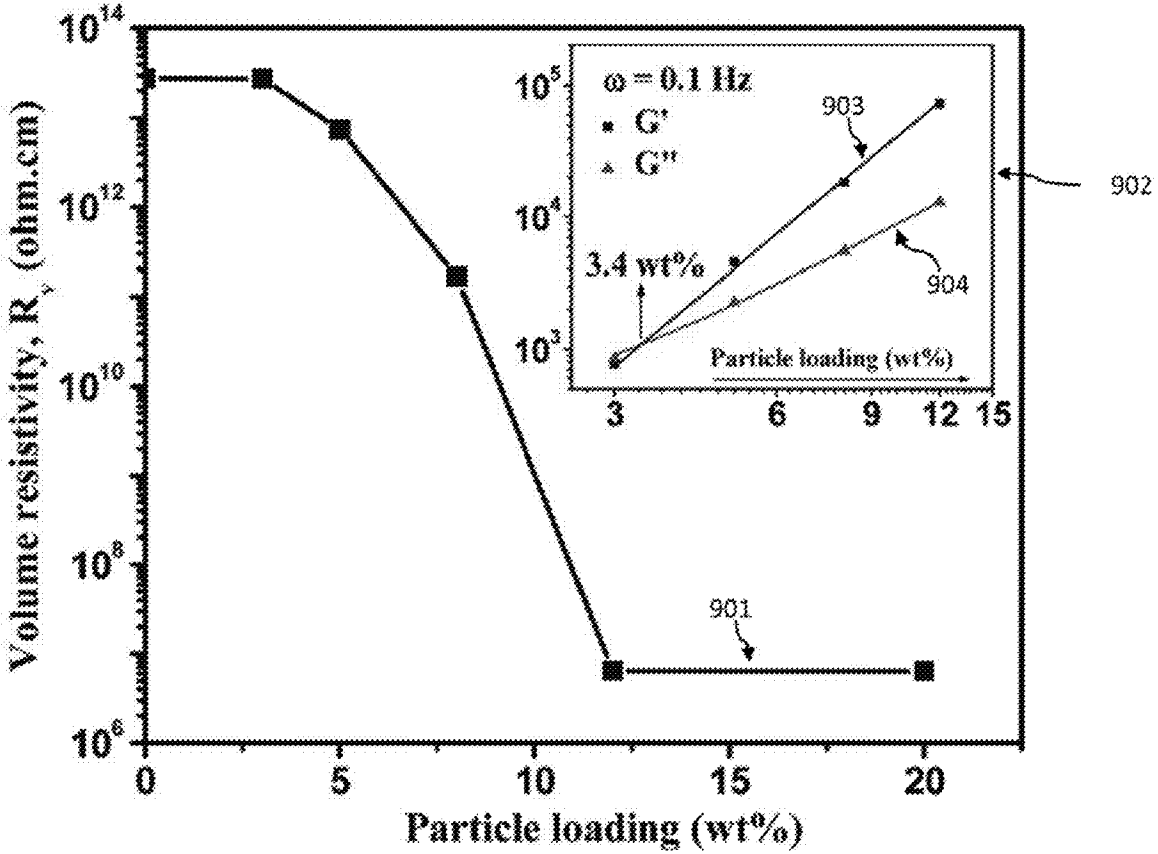
FIG. 9 is a graph of the change of volume resistivity as a function of nanoparticle loading.

FIG. 9 shows the electrical conductivity (σ) of the PNCs with different nanoparticle loadings. Three distinct stages could be identified on the conductivity curve 901. The addition of 3 wt % NPs showed a negligible reduction in the resistivity with the same order of magnitude (~1013 Ω3·cm), indicating an insulator behavior. As the nanoparticle loading increases to 5 wt %, the resistivity began to decrease owing to the tunneling effect between the neighboring NPs. With further increasing particle loading, the resistivity of the PNCs decreased significantly and was reduced by 6 orders of magnitude (~107 Ω3·cm) when the particle loading reached 12 wt (~2.3 vol %). After that, further addition of the particle loading did not contribute to the reduction of the resistivity. Comparing with the prominent geometrical models created by Kirkpatrick [Kirkpatrick 1973] and Zallen [Zallen,' 1983], the required minimum touching spherical particle loading was 16 vol %, which was in approximately agreement with most experimental observations that the critical volume fraction was between 5 and 20 vol % for PNCs filled with powdery materials. The lower observed percolation threshold 5-12 wt % (0.96-2.3 vol %) in this work was primarily attributed to the small particle size and good dispersion of the NPs from this in situ method, as evidenced by the TEM observations shown in FIGS. 3A-3H.

Figures 10A, 10B, 10C:
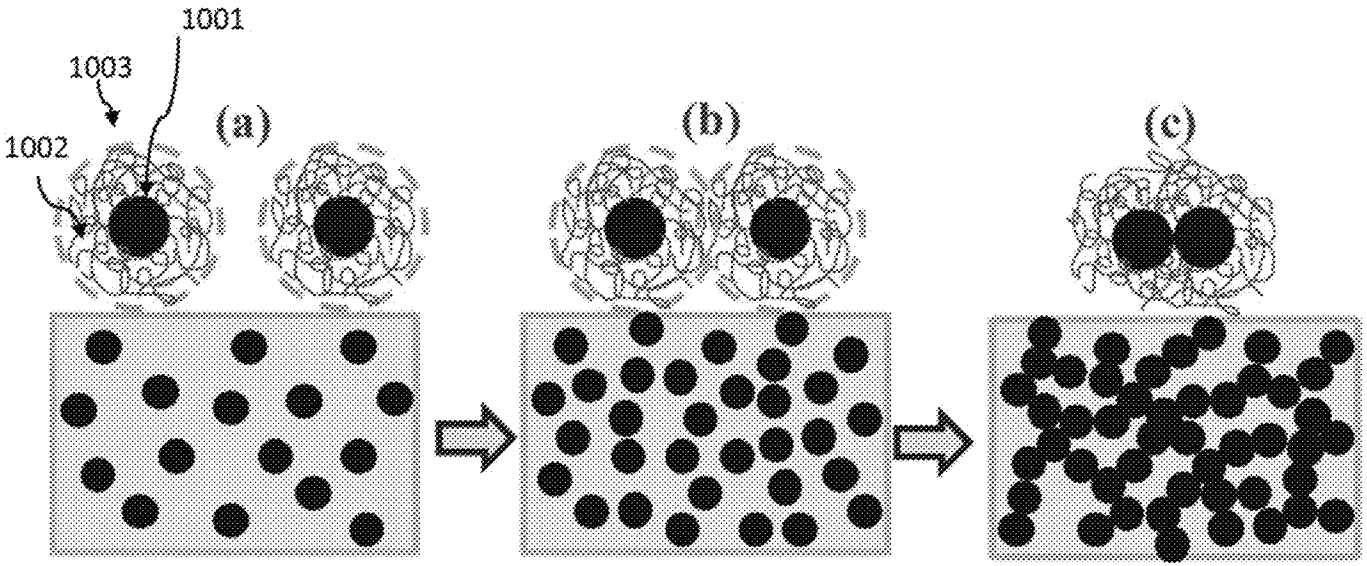
FIGS. 10A-10C are schematic illustrations of the gradually formed nanoparticle percolation. The polymer chains (1002) wrapped on the NPs (1001) and formed a "real radius" (1003). Shown in FIGS. 10A-10C, respectively, are (a) separated NPs from both rheological and electrical percolation points, (b) theologically interconnected NPs, and (c) electrically interconnected NPs.

Inset 902 of FIG. 9 depicts the G' (903) and G" (904) against filler loading at the low oscillation frequency of 0.1 Hz, in which the crossing point was used to determine the rheological percolation of the PNCs. [Zhu 2010 IV]. The observed rheological percolation was about 3.4 wt % (0.65 vol %), which was much lower than the electrical percolation of 5-12 wt % (0.96-2.3 vol %). FIGS. 10A-10C show the schematic model of the gradually formed particle percolation. The NPs (1001) are physically wrapped with polymer chains (1002) due to their large specific surface area and their strong affinity with the surrounding media, which form a particle complex (the thickness of the polymer wrapping layer plus the radius of the NPs). The formed nanoparticle complex was actually larger than the radius of the bare NPs. This "real radius" (1003) was particularly effective in the rheological properties. Once the distance between the NPs got close to double of the "real radius," the wrapped NPs formed an interconnected network, which was called "rheological percolation". However, the resistivity analysis indicated that this distance was not close enough to form a network structure for the electrons to pass through the neighboring NPs as a "tunneling effect" (the resistivity did not change with 3 wt % NPs). Therefore, a higher particle loading was needed to reach the electrical percolation. While increasing the filler loading from 5 to 8 wt %, the reduced interparticle distance led to the "tunneling effect" and meanwhile the network structure began to form, thus a gradually decreased resistivity was observed. The resistivity reached a saturation value at the loading' of 12 wt % and it did not change as the filler loading further increased to 20 wt %. This indicated that a network of NPs had been formed completely at the loading of 12 wt % and the significantly reduced resistivity was due to the electron pathway created by the direct contact of the NPs.

Dielectric Properties

Figure 11A:
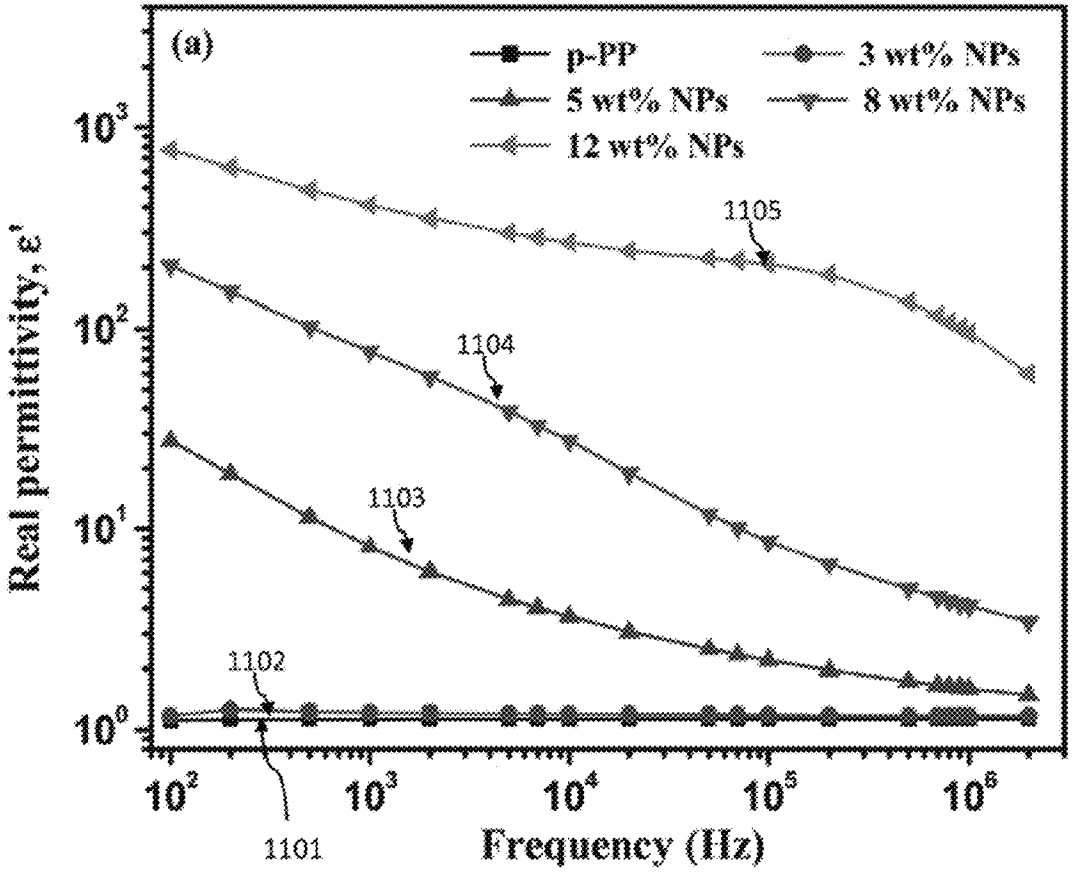
FIGS. 11A-11B are graphs of (11A) real permittivity (∈'), and (11B) imaginary permittivity (∈") as a function of frequency for PP and its PNCs.
Figure 11B:
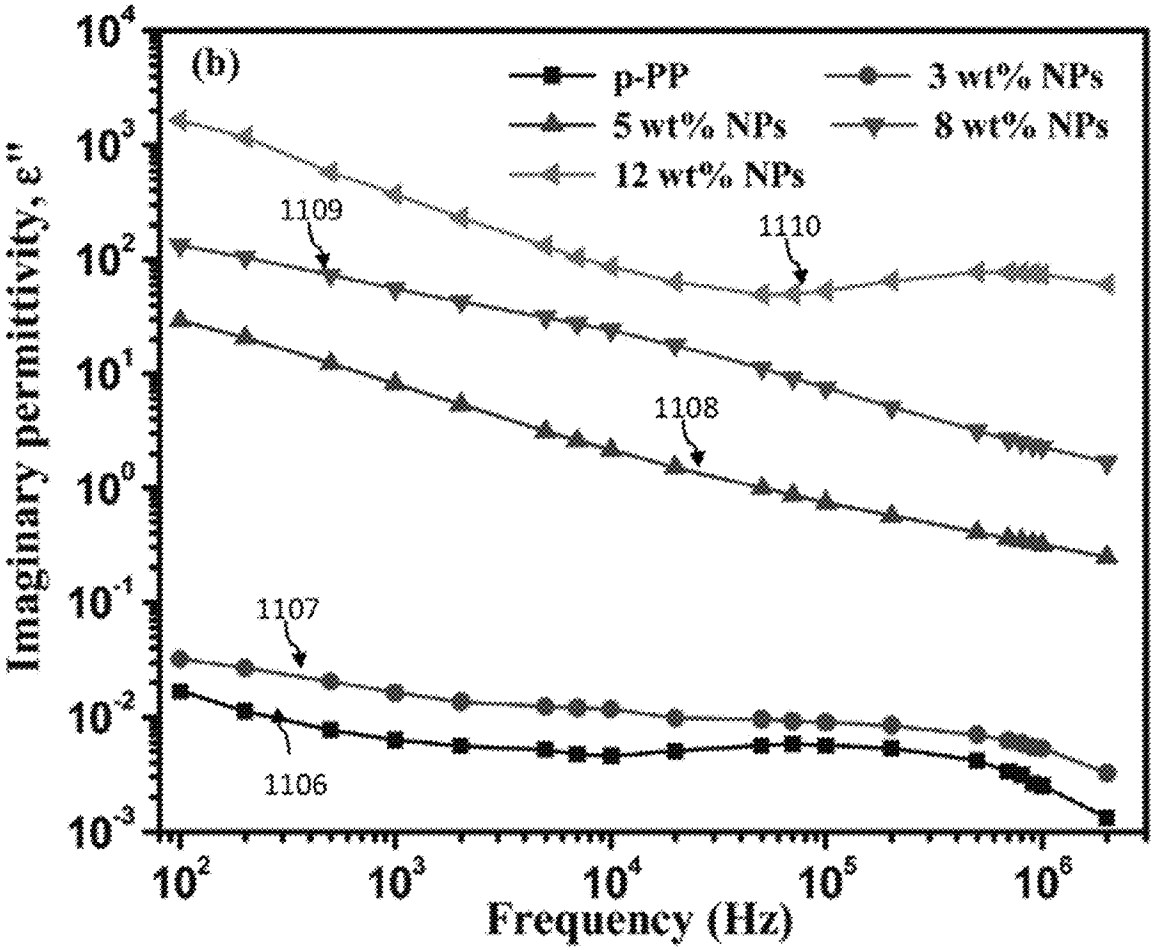

FIGS. 11A-11B show, respectively, the room temperature real permittivity (∈') and imaginary permittivity (∈") as a function of frequency for pure PP and its PNCs with different nanoparticle loadings. For FIG. 11A, the curves are pure PP (1101) and its PNCs (3, 5, 8, and 12 wt % at 1102-1105. FIG. 11B, the curves are pure PP (1106) and its PNCs (3, 5, 8, and 12 wt % at 1107-1110.

As shown in FIG. HA, Pure PP and PNCs with a nanoparticle loading of 3 wt % were observed to exhibit constant ∈' value. However, the PNCs with particle loadings larger than 3 wt % show a dielectric relaxation behavior (∈' decreases with increasing frequency). This result was in good agreement with the variation of electrical resistance of the PNCs, where a transition starts from the concentration of 5 wt % (often called "percolation"). It is worth noting that both ∈' and ∈" of the PNCs were enhanced significantly by orders of magnitude near the percolation, as shown in FIGS. 11A-11B, respectively. The obtained ∈' value is 770 for the PNCs with 12 wt % filler loading, which was about 700 times larger than that of pure PP. The significantly enhanced real dielectric permittivity indicated that the thin insulating PP layer physically wrapped on the nanoparticle surface was still dielectrically strong to hold the charge carriers in the NPs at low frequency. The dielectric permittivity of the PNCs with filler content higher than 3 wt % decreased toward high frequency, suggesting that the insulating layer was not stable and easily affected by the external frequency disturbance. Similar observations were also observed in the MWCNT/poly-(vinyldenefluoide) PNCs. [bang 2007].

Thermal Properties

Figure 12A:
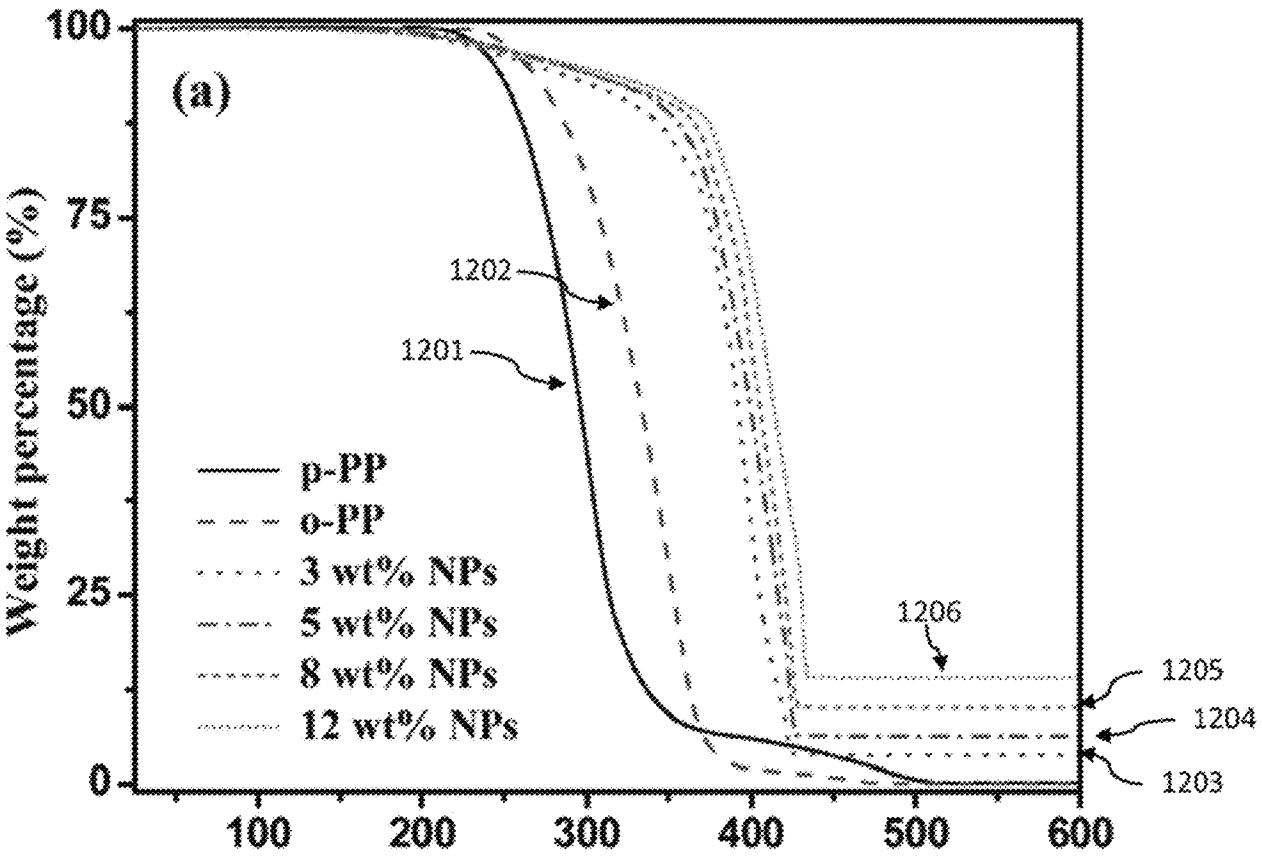
FIGS. 12A-12B are graphs of thermogravimetric curves of PP and its PNCs (12A) in air and (12B) in nitrogen.
Figure 12B:
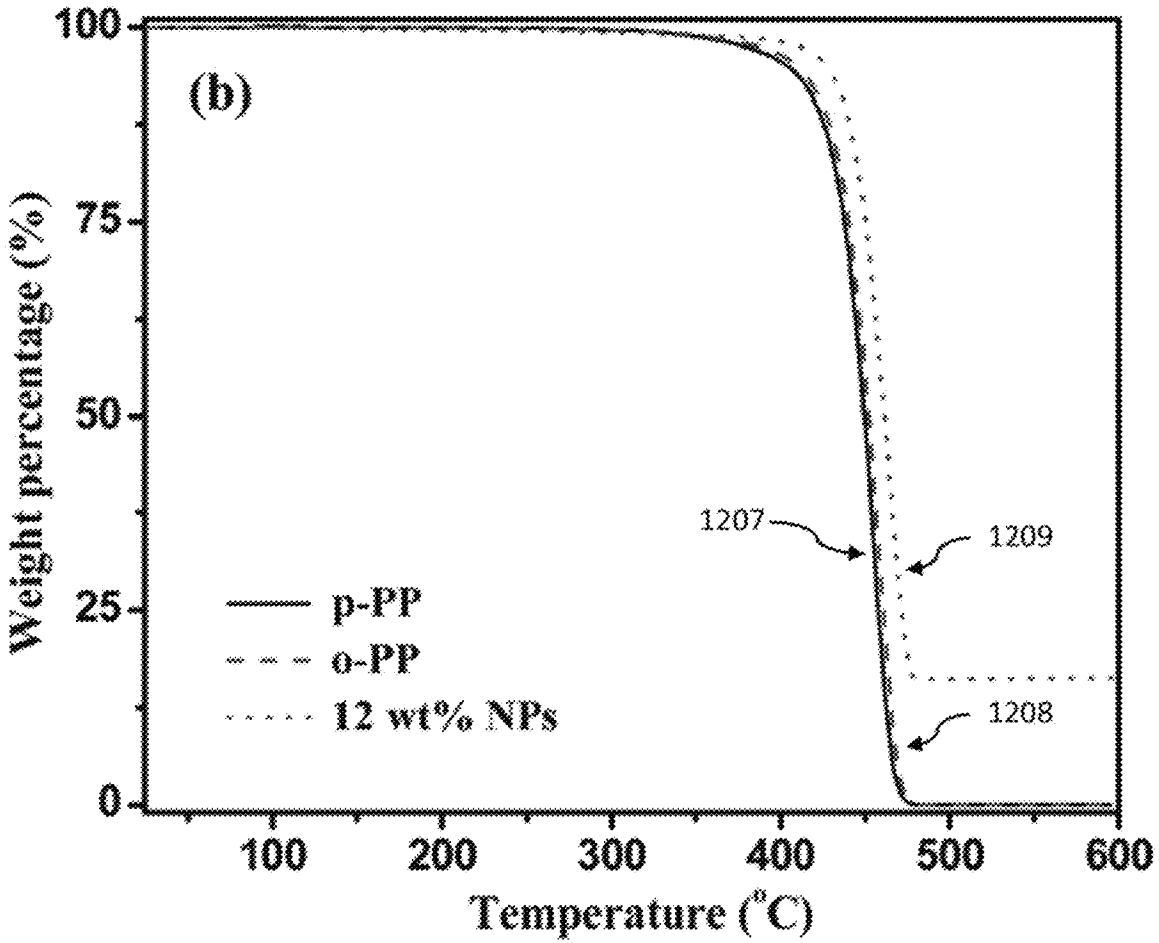

FIGS. 12A-12B are graphs of thermogravimetric curves of PP and its PNCs (12A) in air and (12B) in nitrogen. FIG. 12A shows the TGA curves of PP (p-PP 1201 and o-PP 1202) its PNCs with different particle loadings (3, 5, 8, and 12 wt % at 1203-1206, respectively) tested in the air flow condition. The p-PP 1201 showed an onset decomposition temperature ($T_d$) of 251.8° C., while the o-PP 1202 showed a higher $T_d$ at 265.7° C. The decreased thermal stability of the p-PP after processing indicated a reduced interaction between polymer chains and an easy degradation of PP with the air after processed with solvent. A much higher $T_d$ of 370.0, 373.5, 382.9, and 384.0° C. was observed in the PNCs with a nanoparticle loading of 3, 5, 8, and 12 wt %, respectively. In order to disclose the role of the NPs especially with a metal core in the decomposition of the PP, the samples were also tested in a nitrogen flow condition, as shown in FIG. 12B curves of PP (p-PP 1207 and o-PP 1208) and its PNCs with 12 wt % particle loading 1209). As shown in FIG. 12B, only slight thermal stability improvement was observed, which was due to the strong interfacial particle-polymer interaction and was also observed in other polymer nanocomposite systems. [Ge 2004, Kashiwagi 2005, Agag 2001, Zhu 2001]

In addition, as shown in FIG. 12B, o-PP and p-PP were observed to have similar thermal stability, indicating that air promotes the degradation of PP as well after processed with solvent. (Compare with FIG. 12A). The tremendous thermal stability improvement of around 120° C. as compared to p-PP was due to the presence of the NPs, especially with a metal core, as evidenced by Mossbauer spectra of FIG. 5B. Operated in the air condition, iron acted as oxygen trap and thus reduced the oxidation effect of oxygen on the PP molecular chains to give a higher decomposition temperature. The actual residue was 3.6, 6.1, 9.9, and 13.9% for the PNCs reinforced with 3, 5, 8, and 12 wt % NPs, respectively. The theoretically calculated residue based on the NPs was 3.8, 7.0, 11.0, and 16.6%. These slightly higher values than the corresponding actual residues were primarily due to the evaporation of small amount of $Fe(CO)_5$ during the reflux process.

To remove the effect of heat history on the obtained heat data, all the samples were first heated to 250° C. with a heating rate of 10° C./min under nitrogen, allow the samples to maintain at 250° C. for 2 min and then cool down to room temperature with a cooling rate of 10° C./min. Immediately after that, the samples were heated again to 250° C. following the same procedures as used for the first heating process.

Figure 13:
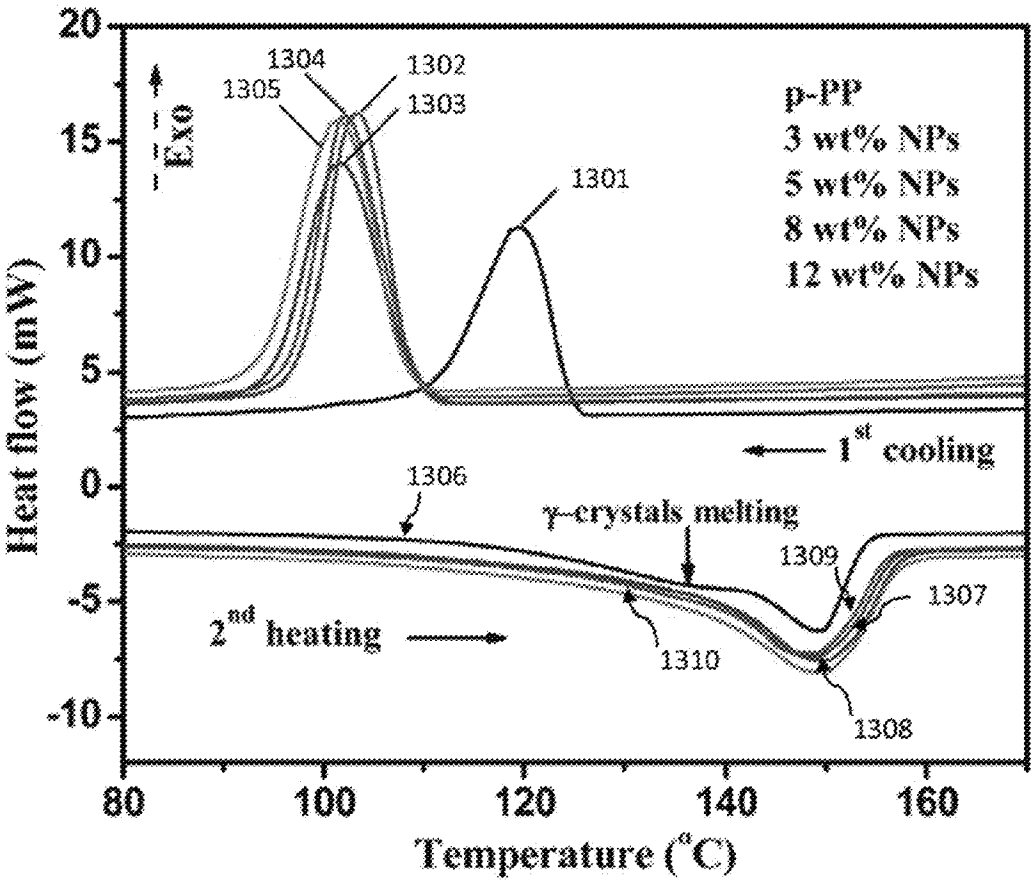
FIG. 13 is a graph of the DSC cooling (first cycle) and heating (second cycle) curves for pure PP and its PNCs.

FIG. 13 is a graph of the DSC cooling (first cycle) and heating (second cycle) curves for pure PP and its PNCs. The first cycle curves are for PP (1301) and its PNCs with different particle loadings (3, 5, 8, and 12 wt % at 1302-1305, respectively). The second cycle curves are for PP (1306) and its PNCs with different particle loadings (3, 5, 8, and 12 wt % at 1307-1310, respectively).

The DSC curves were recorded using the data collected on the first cooling and second heating processes. The melting temperature ($T_m$) of PP was not affected by the addition of the NPs. However, the crystalline temperature ($T_c$) of PP decreased by 16-18° C., where PP was crystallized at 119.8° C. and the PNCs were crystallized at 101-103° C. The lowered $T_c$ was attributed to the strong particlepolymer interaction, which greatly restricted the segmental motion of the polymer chains and inhibited the content of the crystalline structures in the polymer chains. The lowered peak intensity in XRD curves with increasing particle loading together with the crystalline fraction calculated from DSC further confirmed this observation. The broad peak from 125 to 145° C. in pure PP curve was due to the melting of the γ-crystals, while this peak was not observed in the PNCs. This observation was quite consistent with the XRD results that the decreased peak intensity at 20=20.07° (117) corresponded to a lower content of γ-phase PP in the PNCs.

Table 1 above lists the DSC characteristics of PP and its PNCs. The crystalline fraction ($F_c$) of the polymer within the PNCs was calculated from the following equation:

$$F_c = \frac{\Delta H}{209 f_p}$$

where ΔH is the enthalpy of fusion (J/g), 209 J/g is the fusion enthalpy for a theoretically 100% crystalline PP [Yuan 2006], and $f_p$ is the weight fraction of the polymer. The crystallinities were 43.3, 39.9, 43.6, 42.9, and 36.7% for the PNCs with a particle loading of 0, 3, 5, 8, and 12% respectively. The PNCs exhibited lower $F_c$ as compared to pure PP, except for 5 wt % NPs. The lower $F_c$ of the PNCs was attributed to the fact that the NPs are able to disturb the continuity of the polymer matrix and thus introduce more grain boundaries as well as defects, which were also reported previously in high-density polyethylene/MWCNT composites [Yang 2009, Kodjie 2006] and clay reinforced nylon-6 composites [Fornes 2003].

Magnetic Properties

Figure 14:
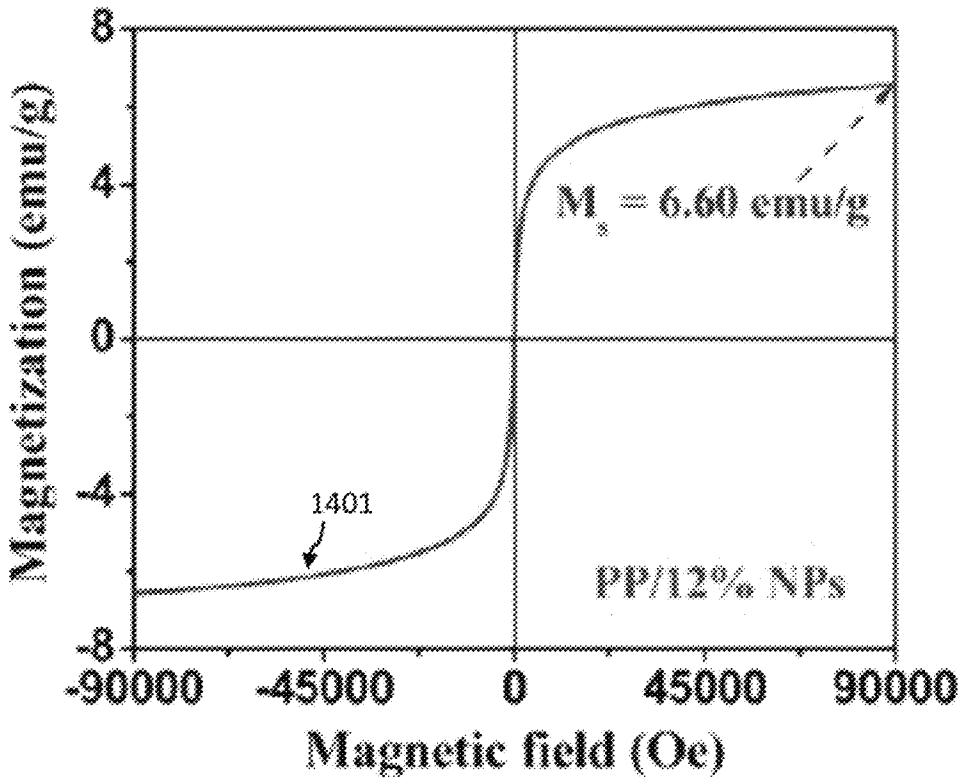
FIG. 14 is a graph of a room temperature hysteresis loop of the PNCs with a 12 wt % particle loading.

FIG. 14 shows the room temperature magnetic hysteresis loop 1401 of the PNCs with a particle loading of 12 wt %. The saturation magnetization ($M_s$) is defined as the state at which an increase in the magnetic field cannot increase the magnetization of the material further. $M_s$ of the PNCs with a particle loading of 12 wt % was estimated to be 6.6 emu/g at a relatively high magnetic field (90 000 Oe). A negligible remanence ($M_r$, the residue magnetization after the applied field is reduced to zero) of 0.14 emu/g and coercivity ($H_c$, the external applied magnetic field necessary to return the material to a zero magnetization condition) of 22.34 Oe were observed, indicating a room temperature soft ferromagnetic behavior of the PNCs.

Accordingly, a surfactant-free in situ method has been found to synthesize multifunctional PNCs with high quality dispersion of NPs. The particle size grows up with the increase of particle loading. Results show that the "rheological percolation" was much lower as compared to the "electrical conductivity percolation" owing to the larger effective radius stemmed from the wrapping polymer chains on the particle surface, which also accounts for the uniform dispersion of the NPs. The sharp change in electrical resistivity and dielectric permittivity of the PNCs show high consistency with each other and both confirm the structural transition starting from 5 wt % particle loading, which was due to the formation of the interparticle network structure (percolation threshold). As a result of the polymer-particle interaction and the oxygen trap of the presence of the metal iron, a significant enhancement in thermal stability of around 120° C. was observed in the PNCs as compared to the p-PP. The magnetic measurement indicated a soft ferromagnetic behavior of these PNCs.

Polypropylene is a low cost polymer which has been widely used in many applications. Adding certain functions into PP would significantly widen its application and increase its value. The synthesis of the present invention is very facile, and can be expanded to many other functional nanoparticles. Multifunctional polypropylenes prepared via this approach have applications in electronic, military, and packaging areas.

A number of embodiments of the invention have been described. Nevertheless, it will be understood that various modifications may be made without departing from the spirit and scope of the invention. Accordingly, other embodiments are within the scope of the following claims.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. For example, the selection traces could be replaced with an array of conventional silicon switches to address individual cells. Accordingly, other embodiments are within the scope of the following claims. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

REFERENCES

Agag, T.; Koga, T.; Takeichi, T. Polymer 2001, 42, 3399-3408 ("Agag 2001").

Auriemma, F.; De Rosa, C. Macromolecules 2002, 35, 9057-9068 ("Auriemma 2002").

Ban, Z.; A. Barnakov, Y.; Li, F.; O. Golub, V.; J. O'Connor, C. J. Mater. Chem. 2005, 15, 4660-4662 ("Ban 2005").

Barrau, S.; Demont, P.; Perez, E.; Peigney, A.; Laurent, C.; Lacabanne, C. Macromolecules 2003, 36, 9678-9680 ("Barrau 2003").

Battisha, I. K.; Afify, H. H.; Ibrahim, M. J. Magn. Magn. Mater. 2006, 306, 211-217 ("Battisha 2006").

Bower, D. 1. An Introduction to Polymer Physics. Cambridge University Press: New York, 2002 ("Bower 2002").

Boyer, C.; Bulmus, V.; Priyanto, P.; Teoh, W. Y.; Amal, R.; Davis, T. P. J. Mater. Chem. 2009, 19, 111-123 ("Boyer 2009").

Chen, X.; Wei, S.; Yadav, A.; Patil, R.; Zhu, J.; Ximenes, R.; Sun, L.; Guo, Z. Macromol. Mater. Eng. 201110.1002/mame.201000341 ("Chen").

Dang, Z. M.; Wang, L.; Yin, Y.; Zhang, Q.; Lei, Q. Q. Adv. Mater. 2007, 19, 852-857 ("Dung 2007").

Du, F.; Scogna, R. C.; Zhou, W.; Brand, S.; Fischer, J. E.; Winey, K. I. Macromolecules 2004, 37, 9048-9055 ("Du 2004").

Fang, D.; Huang, K.; Liu, S.; Luo, Z.; Qing, X.; Zhang, Q. J. Alloys Compd. 2010, 498, 37-41 ("Fang 2010").

Foresta, T.; Piccarolo, S.; Goldbeck-Wood, G. Polymer 2001, 42, 1167-1176 ("Foresta 2001").

Fornes, T. D.; Paul, D. R. Polymer 2003, 44, 3945-3961 ("Ponies 2003").

Ge, J. J.; Hou, H.; Li, Q.; Graham, M. J.; Greiner, A.; Reneker, D. H.; Harris, F. W.; Cheng, S. Z. D. J. Am. Chem. Soc. 2004, 126, 15754-15761 ("Ge 2004").

Gu, J.; Li, S.; Wang, E.; Li, Q.; Sun, G.; Xu, R.; Zhang, H. J. Solid State Chem. 2009, 182, 1265-1272 ("Gu 2009").

Guo, Z.; Lee, S. E.; Kim, H.; Park, S.; Hahn, H. T.; Karki, A. B.; Young, D. P. Acta Mater. 2009, 57, 267-277 ("Guo 2009").

Guo, Z.; Hahn, H. T.; Lin, H.; Karki, A. B.; Young, D. P. J. Appl. Phys. 2008, 104, 014314 ("Guo 2008").

Guo, Z.; Park, S.; Hahn, H. T.; Wei, S.; Moldovan, M.; Karki, A. B.; Young, D. P. Appl. Phys. Lett. 2007, 90, 053111 ("Guo 2007").

Guo, Z.; Park, S.; Hahn, H. T.; Wei, S.; Moldovan, M.; Karki, A. B.; Young, D. P. J. Appl. Phys. 2007, 101, 09M511 ("Gun 2007 II").

(25) Guo, Z.; Park, S.; Wei, S.; Pereira, T.; Moldovan, M.; Karki, A. B.; Young, D. P.; Hahn, H. T. Nanotechnology 2007, 18, 335704 ("Guo 2007 III").

Guo, Z.; Pereira, T.; Choi, 0.; Wang, Y.; Hahn, H. T. J. Mater. Chem. 2006, 16, 2800-2808 ("Guo 2006").

Gupta, A. K.; Gupta, M. Biomaterials 2004, 26, 3995-4021 ("Gupta 2004").

Hyun, Y. H.; Lim, S. T.; Choi, H. J.; Jhon, M. S. Macromolecule 2001, 34, 8084-8093 ("Hyun 2001").

Huxtable, S. T.; Cahill, D. G.; Shenogin, S.; Xue, L.; Ozisik, R.; Barone, P.; Usrey, M.; Strano, M. S.; Siddons, G.; Shim, M.; Keblinski, P. Nat. Mater. 2003, 2, 731-734 ("Huxtable 2003").

Kashiwagi, T.; Du, F.; Douglas, J. F.; Winey, K. I.; Harris, R. H.; Shields, J. R. Nat. Mater. 2005, 4, 928-933 ("Kashiwagi 2005").

Kataby, G.; Prozorov, T.; Koltypin, Y.; Cohen, H.; Sukenik, C. N.; Ulman, A.; Gedanken, A. Langmuir 1997, 13, 6151-6158 ("Kataby 1997").

Kim, P.; Doss, N. M.; Tillotson, J. P.; Hotchkiss, P. J.; Pan, M.-J.; Marder, S. R.; Li, J.; Calame, J. P.; Perry, J. W. ACS Nano 2009, 3, 2581-2592 ("Kim, P. 2009").

Kim, H.; Macosko, C. W. Polymer 2009, 50, 3797-3809 ("Kim, H. 2009").

Kotsilkova, R.; Fragiadakis, D.; Pissis, P. J. Polym. Sci., Part B: Polym. Phys. 2005, 43, 522-533 ("Kotsilkova 2005").

Kirkpatrick, S. Rev. Mod. Phys. 1973, 45, 574 ("Kirkpatrick 1973").

Kodjie, S. L.; Li, L.; Li, B.; Cai, W.; Li, C. Y.; Keating, M. J. Macromol. Sci. Part B Phys. 2006, 45, 231-245 ("Kodjie 2006").

Krishnamoorti, R.; Giannelis, E. P. Macromolecules 1997, 30, 4097-4102 ("Krislmamoorti 1997").

Lee, J. H.; Huh, Y. M.; Jun, Y.-W.; Seo, J.-W.; Jang, J.-T.; Song, H.-T.; Kim, S.; Cho, E.-J.; Yoon, H.-G.; Suh, J.-S.; Cheon, J. Nat. Med. 2007, 13, 95-99 ("Lee 2007").

Li, G.; Joshi, V.; White, R. L.; Wang, S. X.; Kemp, J. T.; Webb, C.; Davis, R. W.; Sun, S. J. Appl. Phys. 2003, 93, 7557-7559 ("Li 2003").

Li, L.; Li, G.; Smith, R. L.; Inomata, H. Chem. Mater. 2000, 12, 3705-3714 ("Li 2000").

Lu, Y.; Yin, Y.; Mayers, B. T.; Xia, Y. Nano Lett. 2002, 2, 183-186 ("Lu 2002").

Lu, Z.; Prouty, M. D.; Guo, Z.; Golub, V. O.; Kumar, C. S. S. R.; Lvov, Y. M. Langmuir 2005, 21, 2042-2050 ("Lu 2005").

Luo, Z. P. Acta Mater. 2006, 54, 47-58 ("Luo 2006").

Meincke, O.; Kaempfer, D.; Weickmann, H.; Friedrich, C.; Vathauer, M.; Warth, H. Polymer 2004, 45, 739-748 ("Meincke 2004").

Oprea, C.; Viorel, I. Ovidius Univ. Ann. Chem. 2009, 20, 222-226 ("Oprea 2009").

McNally, T.; P€ otschke, P.; Halley, P.; Murphy, M.; Martin, D.; Bell, S. E. J.; Brennan, G. P.; Bein, D.; Lemoine, P.; Quinn, J. P. Polymer 2005, 46, 8222-8232 ("McNally 2005").

Mezghani, K.; Phillips, P. J. Polymer 1998, 39, 3735-3744 ("Mezghani 1998").

Mczghani, K.; Phillips, P. J. Polymer 1995, 36, 2407-2411 ("Mezghani 1995").

Mikutta, C.; Mikutta, R.; Bonneville, S.; Wagner, F.; Voegelin, A.; Christi, 1.;

Kretzschmar, R. Geochim. Cosmochim. Acta 2008, 72, 1111-1127 ("Mikutta 2008").

Mitchell, C. A.; Bahr, J. L.; Arepalli, S.; Tour, J. M.; Krishnamoorti, R. Macromolecules 2002, 35, 8825-8830 ("Mitchell 2002").

Poslinski, A. J.; Ryan, M. E.; Gupta, R. K.; Seshadri, S. G.; Frechette, F. J. J. Rheol. 1988, 32, 703-735 ("Poslinski 1988").

Potschke, P.; Abdel-Goad, M.; Alig, 1.; Dudkin, S.; Lellinger, D. Polymer 2004, 45, 8863-8870 ("Potschke 2004").

Potschke, P.; Forties, T. D.; Paul, D. R. Polymer 2002, 43, 3247-3255 ("Potschke 2002").

Qin, H.; Zhang, S.; Zhao, C.; Hu, G.; Yang, M. Polymer 2005, 46, 8386-8395 ("Qin 2005").

Sandler, J. K. W.; Kirk, J. E.; Kinloch, I. A.; Shaffer, M. S. P.; Windle, A. H. Polymer 2003, 44, 5893-5899 ("Sandler 2003").

Shenoy, A. V. Rheology of filled polymer systems. Kluwer Academic. Publishers: Dordrecht, The Netherlands, 1999 ("Shenoy 1999").

Shimada, T.; Ookubo, K.; Komuro, N.; Shimizu, T.; Uehara, N. Langmuir 2007, 23, 11225-11232 ("Shimada 2007").

Sidorov, S. N.; Bronstein, L. M.; Davankov, V. A.; Tsyurupa, M. P.; Solodovnikov, S. P.; Valetsky, P. M.; Wilder, E. A.; Spontak, R. J. Chem. Mater. 1999, 11, 3210-3215 ("Sidorov 1999").

Smith, T. W.; Wychick, D. J. Phys. Chem. 1980, 84, 1621-1629 ("Smith 1980").

Sun, L.; Boo, W.-J.; Liu, J.; Clearfield, A.; Sue, H.-J.; Verghese, N. E.; Pham, H. Q.; Bicerano, J. Macromol. Mater. Eng. 2009, 294, 103-113 ("Sun 2009").

Tasis, D.; Tagmatarchis, N.; Bianco, A.; Prato, M. Chem. Rev. 2006, 106, 1105-1136 ("Tasis 2006").

Terris, B. D.; Thomson, T. J. Phys. D: Appl. Phys. 2005, 38, R199-R222 ("Terris 2005").

Tseng, C.-H.; Wang, C.-C.; Chen, C.-Y. Chem. Mater. 2006, 19, 308-315 ("Tseng 2006").

Ugaz, V. M.; Cinader, D. K.; Burghardt, W. R. Macromolecules 1997, 30, 1527-1530 ("Ugaz 1997").

Van Wonterghem, J.; Mørup, S.; Charles, S. W.; Wells, S.; Villadsen, J. Phys. Rev. Lett. 1985, 55, 410 ("Van Wonterghem 1985").

Wang, Y.; Wei, W.; Maspoch, D.; Wu, J.; Dravid, V. P.; Mirkin, C. A. Nano Lett. 2008, 8, 3761-3765 ("Wang 2008").

Wu, X.; Xu, Q.; Shang, S.; Shui, J.; Liu, C.; Zhu, Z. Chin. Phys. Lett. 2008, 25, 1388-1391 ("Wu 2008").

Yang, J.; Wang, C.; Wang, K.; Zhang, Q.; Chen, F.; Du, R.; Fu, Q. Macromolecules 2009, 42, 7016-7023 ("Yang 2009").

Yang, Y.; Xie, X.; Yang, Z.; Wang, X.; Cui, W.; Yang, J.; Mai, Y.-W. Macromolecules 2007, 40, 5858-5867 ("Yang 2007").

Yuan, Q.; Misra, R. D. K. Polymer 2006, 47, 4421-4433 ("Yuan 2006").

Zallen, R. The Physics of Amorphous Solids; Wiley: New York, 1983 ("Zallen 1983").

Zhang, D.; Wei, S.; Kaila, C.; Su, X.; Wu, J.; Karki, A. B.; Young, D. P.; Guo, Z. Nanoscale 2010 2, 917-919 ("Zhang 2010").

Zhu, J.; Wei, S.; Alexander, M., Jr.; Dang, T. D.; Ho, T. C.; Guo, Z. Adv. Func. Mater. 2010, 18, 3076-3084 ("Zhu 2010").

Zhu, J.; Wei, S.; Ryu, J.; Budhathoki, M.; Liang, G.; Guo, Z. J. Mater. Chem. 2010, 20, 4937-4948 ("Zhu 2010 II").

Zhu, J.; Wei, S.; Ryu, J.; Sun, L.; Luo, Z.; Guo, Z. ACS Appl. Mater. Interfaces 2010, 2, 2100-2107 ("Zhu 2010 III").

Zhu, J.; Wei, S.; Yadav, A.; Guo, Z. Polymer 2010, 51, 2643-2651 ("Zhu 2010 IV").

Zhu, J.; Morgan, A. B.; Lamelas, F. J.; Wilkie, C. A. Chem. Mater. 2001, 13, 3774-3780 ("Zhu 2001").

Zou, X. D.; Sukharev, Y.; Hovmoller, S. Ultramicroscopy 1993, 49, 147-158 ("Zou 1993").

What is claimed is:

1. A method comprising:

(a) dissolving polypropylene in a solvent by refluxing to produce a dissolved polypropylene solution;

(b) adding $Fe(CO)_5$ to the dissolved polypropylene solution to produce a surfactant-free mixture; and (c) refluxing the mixture until the $Fe(CO)_5$ is decomposed and forms $Fe@Fe_2O_3$ nanoparticles.

2. The method as recited in claim 1, wherein the $Fe(CO)_5$ is added to the dissolved polypropylene solution in a ratio of about 2.17-17.48 grams of precursor to 20 grams of polypropylene.

3. The method as recited in claim 1, further comprising evaporating the solvent from the mixture.

4. The method as recited in claim 3, wherein the solvent is xylene.

5. The method as recited in claim 4, wherein the refluxing is performed at about 140° C.

6. The method as recited in claim 1, wherein the $Fe@Fe_2O_3$ nanoparticles are physically wrapped by the polypropylene to form polymer nanocomposites.

7. The method as recited in claim 6, wherein the $Fe@Fe_2O_3$ nanoparticles comprise 3-20 wt. % of the polymer nanocomposites.

8. The method as recited in claim 1, wherein step (c) further comprises the $Fe(CO)_5$ decomposing to $Fe(CO)_{12}$ which then decomposes to form metallic nanoparticles, which then oxidize to form an $Fe_2O_3$ shell on the metallic nanoparticles.

9. A magnetic polymer nanocomposite comprising:

(a) polypropylene; and (b) $Fe@Fe_2O_3$ nanoparticles, wherein (i) the $Fe@Fe_2O_3$ nanoparticles are substantially evenly distributed within the polypropylene; and (ii) the $Fe@Fe_2O_3$ nanoparticles are wrapped by chains of the polypropylene.

10. The magnetic polymer nanocomposite as recited in claim 9, wherein the $Fe@Fe_2O_3$ nanoparticles comprise 3-20 wt. % of the magnetic polymer nanocomposite.

* * * * *